US007931357B2

(12) United States Patent
Umeda

(10) Patent No.: US 7,931,357 B2
(45) Date of Patent: Apr. 26, 2011

(54) INK JET PRINTER

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 943 days.

(21) Appl. No.: 11/824,132

(22) Filed: Jun. 29, 2007

(65) Prior Publication Data

US 2008/0018721 A1 Jan. 24, 2008

(30) Foreign Application Priority Data

Jul. 1, 2006 (JP) ..... 2006-182874

(51) Int. Cl.
*B41J 2/175* (2006.01)

(52) U.S. Cl. ..... 347/85

(58) Field of Classification Search ..... 347/36, 347/84, 85, 86
See application file for complete search history.

(56) References Cited

U.S. PATENT DOCUMENTS

| | | | | |
|---|---|---|---|---|
| 5,359,356 | A * | 10/1994 | Ecklund | 347/86 |
| 5,398,054 | A | 3/1995 | Fukazawa et al. | |
| 5,608,437 | A * | 3/1997 | Iwata et al. | 347/86 |
| 5,631,681 | A * | 5/1997 | Klaus et al. | 347/85 |
| 5,847,736 | A | 12/1998 | Kanbayashi et al. | |
| 5,909,226 | A | 6/1999 | Takeda | |
| 5,992,985 | A | 11/1999 | Young et al. | |
| 6,010,211 | A | 1/2000 | Betschon | |
| 6,045,211 | A | 4/2000 | Tokuda | |
| 6,068,370 | A | 5/2000 | Miller et al. | |
| 6,113,217 | A | 9/2000 | Araki | |
| 6,199,975 | B1 | 3/2001 | Baitz et al. | |
| 6,276,778 | B1 | 8/2001 | Katayama | |
| 6,626,516 | B2 | 9/2003 | Tsukuda | |
| 6,663,233 | B2 * | 12/2003 | Otsuka et al. | 347/85 |
| 6,799,840 | B2 | 10/2004 | Inamura | |
| 6,840,610 | B2 | 1/2005 | Taniguchi et al. | |
| 6,948,803 | B2 | 9/2005 | Yoshida | |
| 7,121,655 | B2 * | 10/2006 | Silverbrook | 347/86 |
| 7,134,738 | B2 | 11/2006 | Saruta | |
| 7,404,628 | B2 * | 7/2008 | Naka et al. | 347/86 |
| 2001/0026304 | A1 | 10/2001 | Matsuzaki | |
| 2001/0038405 | A1 | 11/2001 | Ishizawa et al. | |
| 2003/0038865 | A1 | 2/2003 | Inamura | |

(Continued)

FOREIGN PATENT DOCUMENTS

| | | |
|---|---|---|
| CN | 1377779 | 11/2002 |

(Continued)

OTHER PUBLICATIONS

U.S. Appl. No. 11/824,135, filed Jun. 29, 2007, Umeda.

(Continued)

*Primary Examiner* — Anh T. N. Vo
(74) *Attorney, Agent, or Firm* — Frommer Lawrence & Haug LLP

(57) ABSTRACT

An ink jet printer is provided with an ink jet head, an ink tank, an actuator, and a member. The ink jet head has an ink passage and a nozzle communicating with the ink passage. The ink tank communicates with the ink passage of the ink jet head. The ink tank is elastically deformable along a vertical direction. The actuator is capable of applying a pushing force to the ink tank in the vertical direction. The member is located at a position which is adjacent to a predetermined side surface of the ink tank.

18 Claims, 23 Drawing Sheets

U.S. PATENT DOCUMENTS

| | | | |
|---|---|---|---|
| 2003/0052938 | A1 | 3/2003 | Inui |
| 2003/0063167 | A1 | 4/2003 | Yoshida |
| 2003/0184771 | A1 | 10/2003 | Yamamoti et al. |
| 2003/0202059 | A1 | 10/2003 | Kimura |
| 2004/0196326 | A1 | 10/2004 | Sasa |
| 2005/0146545 | A1 | 7/2005 | Richards |
| 2005/0151782 | A1 | 7/2005 | Ishida et al. |
| 2005/0206667 | A1 | 9/2005 | Ohama et al. |
| 2006/0082622 | A1 | 4/2006 | Yonekawa et al. |
| 2007/0052750 | A1 | 3/2007 | Tokuno et al. |
| 2008/0030530 | A1 | 2/2008 | Ishida et al. |

FOREIGN PATENT DOCUMENTS

| | | |
|---|---|---|
| CN | 1636750 | 7/2005 |
| JP | 59012855 | 1/1984 |
| JP | 62284749 | 12/1987 |
| JP | 04358844 | 12/1992 |
| JP | 9258341 | 10/1997 |
| JP | 10-114081 | 5/1998 |
| JP | 10-114084 | 5/1998 |
| JP | 10-244686 | 9/1998 |
| JP | 2000-246918 | 9/2000 |
| JP | 2001219570 | 8/2001 |
| JP | 2002-113879 | 4/2002 |
| JP | 2002-273901 | 9/2002 |
| JP | 2003-312000 | 11/2003 |
| JP | 2004-209847 | 7/2004 |
| JP | 2004195929 | 7/2004 |
| JP | 2004358918 | 12/2004 |

OTHER PUBLICATIONS

U.S. Appl. No. 11/824,132, filed Jun. 29, 2007, Umeda.
U.S. Appl. No. 11/824,134, filed Jun. 29, 2007, Umeda.
U.S. Appl. No. 11/824,133, filed Jun. 29, 2007, Takaichiro Umeda.

* cited by examiner

INK JET PRINTER

CROSS-REFERENCE TO RELATED APPLICATION

This application claims priority to Japanese Patent Application No. 2006-182874, filed on Jul. 1, 2006, the contents of which are hereby incorporated by reference into the present application.

BACKGROUND OF THE INVENTION

1. Field of the Invention

The present invention relates to an ink jet printer that will print on a print medium by discharging ink. Note that the word "printer" used in the present specification is to be interpreted in the broadest sense, and is a concept that includes a facsimile device, a copy machine, a multi-function device, and the like.

2. Description of the Related Art

Ink jet printers are widely known. An ink jet printer comprises an ink jet head having an ink passage and a nozzle that communicate therewith. For example, an ink jet printer disclosed in Japanese Patent Application Publication No. 2004-358918 comprises a carriage on which an ink jet head is mounted. With this type of ink jet printer, ink will be discharged from the ink jet head while the carriage moves.

The ink jet printer of the aforementioned reference comprises an ink tank that communicates with the ink passage of the ink jet head, and an ink cartridge that communicate with the ink tank. The ink tank has a bellows shape. The ink tank expands and contracts due to ink flowing in and out thereof.

BRIEF SUMMARY OF THE INVENTION

The present inventor has discovered technology that achieves a predetermined object by applying a pressing force to an ink tank that is in communication with the ink jet head. For example, ink can be discharged from the nozzle of the ink jet head by applying a pressing force to the ink tank. In addition, for example, ink can be supplied from the ink cartridge to the ink tank by applying a pressing force to the ink tank, and then releasing the pressing force when the ink cartridge is in communication with the ink tank. The present inventor has considered the desire to fix the amount of contraction of the ink tank when the ink tank is caused to contract by applying a pressing force to the ink tank in the vertical direction. For example, the ink tank will swell in the horizontal direction when the ink tank is caused to contract in the vertical direction. The amount of contraction in the ink tank in the vertical direction will not be stable when the aforementioned expansive deformation occurs, even if the same pressing force is applied to the ink tank. The present specification discloses technology that will make it possible for the ink tank to be stably contracted.

An ink jet printer disclosed by the present specification comprises an ink jet head, an ink tank, and an actuator. The ink jet head has an ink passage and a nozzle communicating to the ink passage. The ink tank communicates with the ink passage of the ink jet head. The ink tank is capable of elastic deformation in the vertical direction. The actuator is capable of applying a pushing force to the ink tank in the vertical direction. The ink jet printer comprises a member that is located at a position adjacent to a predetermined side surface of the ink tank.

According to the aforementioned construction, the ink tank can be caused to elastically deform (contract) in the vertical direction by applying a pushing force to the ink tank in the vertical direction. The member is arranged in a position adjacent to the predetermined side surface of the ink tank. Because of this, the ink tank will come into contact with the member, even if the ink tank swells in the horizontal direction when the ink tank is caused to contract in the vertical direction. This can control the swelling of the ink tank in the horizontal direction. According to this construction, the amount of contraction of the ink tank can be stabilized when the same pushing force is applied to the ink tank in the vertical direction. Note that this technology can be applied to a serial printer in which the ink jet head is mounted on the carriage, as well as to a line printer in which the ink jet head is fixed.

BRIEF DESCRIPTION OF THE DRAWINGS

FIG. 13 shows a capping mechanism.

FIG. 15 shows the structure of a female joint and a male joint.

FIG. 16 shows a simplified structure of the ink supply mechanism.

FIG. 18 shows the structure of the maintenance mechanism.

DETAILED DESCRIPTION OF THE INVENTION

First Embodiment

An embodiment will be described with reference to the drawings. Note that the embodiment described below is simply one example of the present invention. The embodiment described below can be suitably changed within a scope that does not change the essence of the present invention.

Figure 1:
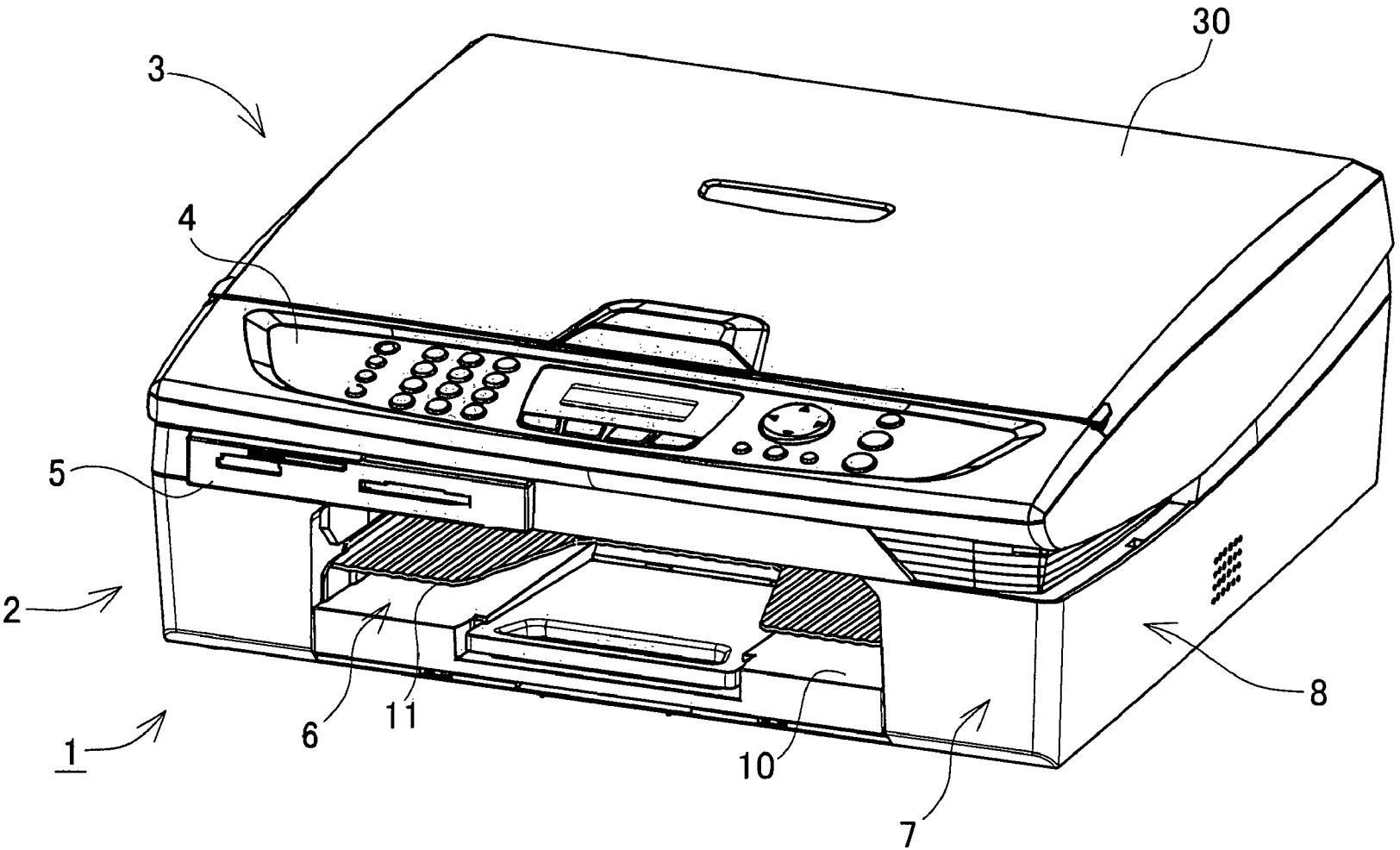
FIG. 1 shows an oblique view of an MFD (multi-function device).

FIG. 1 shows an oblique view of a multi-function device 1. The multi-function device 1 comprises a printer unit 2 and a scanner unit 3. The printer unit 2 is located above the scanner unit 3. The multi-function device 1 has a print function, a scan function, a copy function, a facsimile function, and the like. The printer unit 2 is an ink jet type.

The multi-function device 1 may be connected to and used with an external information processing device such as a computer or the like. The multi-function device 1 can print images and text on a print medium (e.g., a printing sheet) based upon print data including image data and text data transmitted from a computer or the like. The multi-function device 1 may also be connected to and used with a digital camera or the like. The multi-function device 1 may also print image data output from a digital camera or the like onto a printing sheet. In addition, the multi-function device 1 can also print image data or the like stored in a storage medium such as a separately mounted memory card or the like onto a printing sheet.

The multi-function device 1 has a rectangular shape. The multi-function device 1 has a width that is larger than the height thereof, and a depth that is larger than the height thereof. The printer unit 2 has a casing 8. A port 6 is formed in the front surface of the casing 8. The printer unit 2 has a feeding tray 10 and a discharge tray 11. The feeding tray 10 and the discharge tray 11 are arranged on the inner side of the port 6. The discharge tray 11 is arranged above the feeding tray 11. The feeding tray 10 can house various sizes of printing sheets, e.g., A4 size or smaller.

A door 7 is arranged on the right lower portion of the front of the casing 8. A cartridge mounting unit 9 (see FIG. 3) is arranged on the inner side of the door 7. When the door 7 is opened, the cartridge mounting portion 9 will be exposed on the front side. A user can replace an ink cartridge 38 (see FIG. 3) that is mounted in the cartridge mounting unit 9. The cartridge mounting unit 9 has storage chambers that correspond to each color of ink. In the present embodiment, five colors of ink are used (cyan (C), magenta (M), yellow (Y), photoblack (PBk), and black (Bk)). Thus, five storage chambers are arranged in the cartridge mounting unit 9. Each storage chamber houses an ink cartridge 38A to 38E of each corresponding color.

The scanner unit 3 is a so-called flat bed scanner. The multi-function device 1 has a document cover 30. A platen glass on which a document is to be mounted, an image sensor that will read the document, and the like are arranged below the document cover 30.

An operation panel 4 for operating the printer unit 2 and the scanner unit 3 is arranged on the upper portion of the front of the multi-function device 1. The operation panel 4 is comprised of various operation buttons and a liquid crystal display. The multi-function device 1 will operate based upon operational commands from the operation panel 4. If the multi-function device 1 is connected to an external computer, the multi-function device 1 can also operate based upon commands transmitted from the computer via a printer driver or a scanner driver. A slot unit 5 is arranged in the left upper portion of the front of the multi-function device 1. The slot unit 5 can house various types of memory cards. When a predetermined operation is added to the operation panel 4, the multi-function device 1 will read out image data stored in the memory card housed in the slot unit 5. That image data will be displayed on the liquid crystal display of the operation panel 4. The user can print any image while viewing the display thereof.

Figure 2:
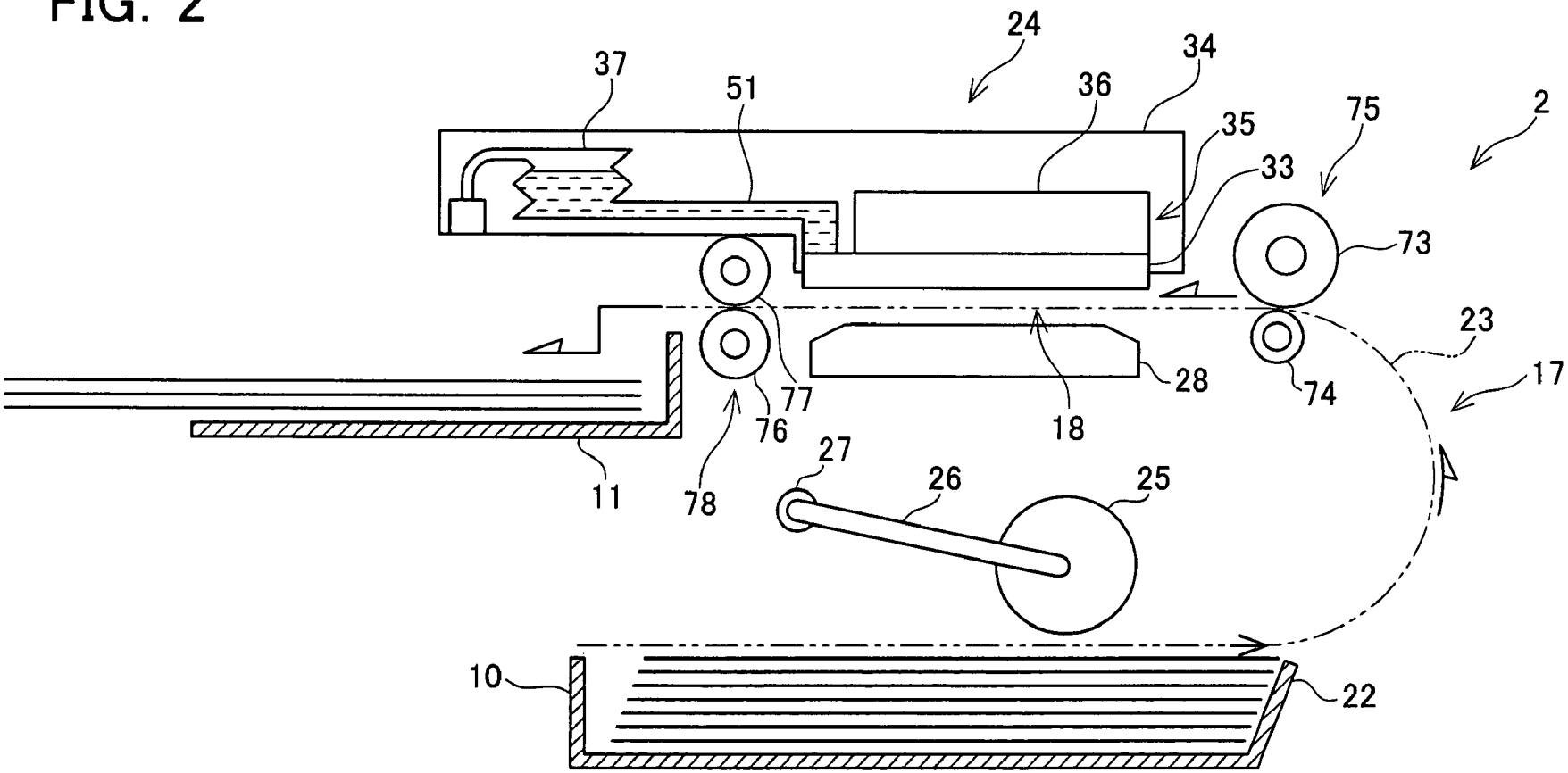
FIG. 2 shows a simple cross-sectional view of a printer unit.

Next, the internal construction of the multi-function device 1 will be described. FIG. 2 shows a simple cross-sectional view of the printer unit 2. An inclined separation plate 22 is arranged on the right edge of the feeding tray 10. The inclined separation plate 22 is inclined to the right. The inclined separation plate 22 is positioned on the right edge of the printing sheets mounted in the feeding tray 10. The inclined separation plate 22 separates only the uppermost printing sheet from a plurality of printing sheets. A paper transport path 23 is arranged above the inclined separation plate 22. Other than the portion where the image recoding unit 24 is disposed, the paper transport path 23 is comprised of an outer side guide surface and an inner side guide surface. The outer side guide surface and the inner side guide surface face each other across a predetermined gap.

The paper transport path 23 extends upward from the feeding tray 10 via the inclined separation plate 22. The paper transport path 23 has a curved path 17 that is curved on the front side, and a straight path 18 that extends in a straight line from the end of the curved path 17 to the front side of the multi-function device 1. The straight path 18 reaches the discharge tray 11 via the image recording unit 24. Printing sheets housed in the feeding tray 10 are guided so as to perform a U-turn in the curved path 17. Printing sheets that have performed a U-turn are transported along the straight path 18. The printing sheets will be printed by the image recording unit 24 in the straight path 18. After that, the printing sheets will be ejected to the discharge tray 11. A roller not shown in the drawings is arranged in the curved path 17. The roller surface of the roller is exposed in the paper transport path 23. The rotation shaft of the roller extends in a direction perpendicular to the plane of FIG. 2. Due to the existence of the roller, the printing sheets will be smoothly transported in the curved path 17.

A paper supply roller 25 is arranged above the feeding tray 10. The paper supply roller 25 will send the printing sheets stacked in the feeding tray 10 to the paper transport path 23. The paper supply roller 25 is supported by one end of an arm 26. The arm 26 is capable of rotating around a base shaft 27 arranged on the other end thereof. The drive force of an LF motor 71 (see FIG. 3) is transmitted to the paper supply roller 25. The drive force of the LF motor 71 is transmitted to the paper supply roller 25 via a drive force transmission mechanism that is constructed by meshing a plurality of gears.

The arm 26 rotates with the base shaft 27 as a center. The arm 26 is urged toward the feeding tray 10. This urging force may be applied to the arm 26 by a spring or the like. In addition, the arm 26 may be urged toward the feeding tray 10 by the weight of the arm 26 itself. In addition, the arm 26 is constructed so as to move upward when the feeding tray 10 is attached to and detached from the casing 8. Because the arm 26 is urged downward, the paper supply roller 25 will contact with the printing sheets in the feeding tray 10. When the paper supply roller 25 rotates, the uppermost printing sheet will be sent toward the inclined separation plate 22 by means of the frictional force between the roller surface of the paper supply roller 25 and the printing sheet. The leading edge of the printing sheet will be placed into contact with the inclined separation plate 22. There will be times in which a plurality of printing sheets will be sent toward the inclined separation plate 22 due to friction or static electricity. When this occurs, the inclined separation plate 22 will separate the uppermost printing sheet from the other printing sheets. Next, the printing sheets will be sent to the paper transport path 23.

The image recording unit 24 is arranged adjacent to the straight path 18. The image recording unit 24 will print (record) images on the printing sheets by discharging ink droplets based upon the ink jet method. The image recording unit 24 has an ink jet head 35 (hereinafter referred to as a "head"), sub tanks 37 (37A to 37E), a carriage 34, and the like. The sub tanks 37 can temporarily store ink. Ink will be supplied from the sub tanks 37 to the head 35. In the present embodiment, five sub tanks 37A to 37E are provided. The five sub tanks 37A to 37E can store different colors of ink.

A platen 28 is arranged below the image recording unit 24. The platen 28 faces the image recording unit 24. Printing sheets are transported above the platen 28. The width of the platen 28 (the length in the direction perpendicular to the plane of FIG. 2) is larger than the width of the biggest printing sheet capable of being printed by the multi-function device 1. Thus, the printing sheets will not run off of the platen 28.

The transport direction of the printing sheets will be hereinafter referred to simply as the "paper transport direction". A pair of transport rollers 75 is arranged on the upstream side of the head 35 in the paper transport direction. The pair of transport rollers 75 has a transport roller 73 and a pinch roller 74. The pinch roller 74 is arranged below the transport roller 73. The transport roller 73 and the pinch roller 74 will grasp printing sheets that are transported via the curved path 17, and transport the printing sheets toward the platen 28. In addition, a pair of discharge rollers 78 is arranged on the downstream side of the head 35 in the paper transport direction. The pair of paper discharge rollers 78 has a paper discharge roller 76 and a pinch roller 77. The pinch roller 77 is arranged above the paper discharge roller 76. The paper discharge roller 76 and the pinch roller 77 grasp the printing sheets printed by the head 35, and transport the printing sheets toward the discharge tray 11. The drive force of the LF motor 71 (see FIG. 3) will be transmitted to the transport roller 73 and the paper discharge roller 76 via a drive force transmission mechanism such as gears or the like.

The pair of transport rollers 75 is arranged on the immediate upstream side of the head 35. The pair of paper discharge rollers 78 is arranged on the immediate downstream side of the head 35. The head 35 is arranged between the pair of transport rollers 75 and the pair of paper discharge rollers 78 in the paper transport direction. Although the separation distance between the pair of transport rollers 75 and the pair of paper discharge rollers 78 is slightly longer than the length of the head 35 in the paper transport direction, the length is set to be substantially the same. By arranging the pair of transport rollers 75 and the pair of paper discharge rollers 78 near the head 35, the separation distance between the pair of transport rollers 75 and the pair of discharge rollers 78 can be shortened. The result is that the ability of the printing sheets transported above the platen 28 to be held can be improved. Deflection of the printing sheets on the platen 28 can be reduced. The quality of images printed on the printing sheets will be improved.

The operation of the LF motor 71 (see FIG. 3) is controlled by a controller that performs overall control of the multi-function device 1. The drive force from the LF motor 71 is transmitted to the t rollers 73, 76. The operation of the rollers 73, 76 is controlled by the aforementioned controller based upon pulse signals output from a rotary encoder linked to the rotation shaft of the transport roller 73. Note that the controller has a circuit board equipped with various electronic devices such as a CPU (Central Processing Unit), a ROM (Read Only Memory), a RAM (Random Access Memory), an EEPROM (Electrically Erasable and Programmable ROM), an ASIC (Application Specific Integrated Circuit), a driver IC, and the like.

Spur shaped bumps are formed on the roller surface of the pinch roller 77. Because of this, deterioration in the quality of images printed on the printing sheets can be prevented, even if the printing sheets are in contact with the pinch roller 77. The pinch roller 77 is capable of sliding in a direction away from the paper discharge roller 76. The pinch roller 77 is urged by a coil spring so as to be placed into contact with the paper discharge roller 76. When the printing sheets advance in between the paper discharge roller 76 and the pinch roller 77, the pinch roller 77 will resist the urging force and retract a distance equal to the thickness of the printing sheets, and the printing sheets will be pushed toward the paper discharge roller 76. In this way, the rotational force of the paper discharge roller 76 will be reliably transmitted. The pinch roller 74 also has the same construction as the aforementioned pinch roller 77. The pinch roller 74 pushes the printing sheets toward the transport roller 73.

Figure 3:
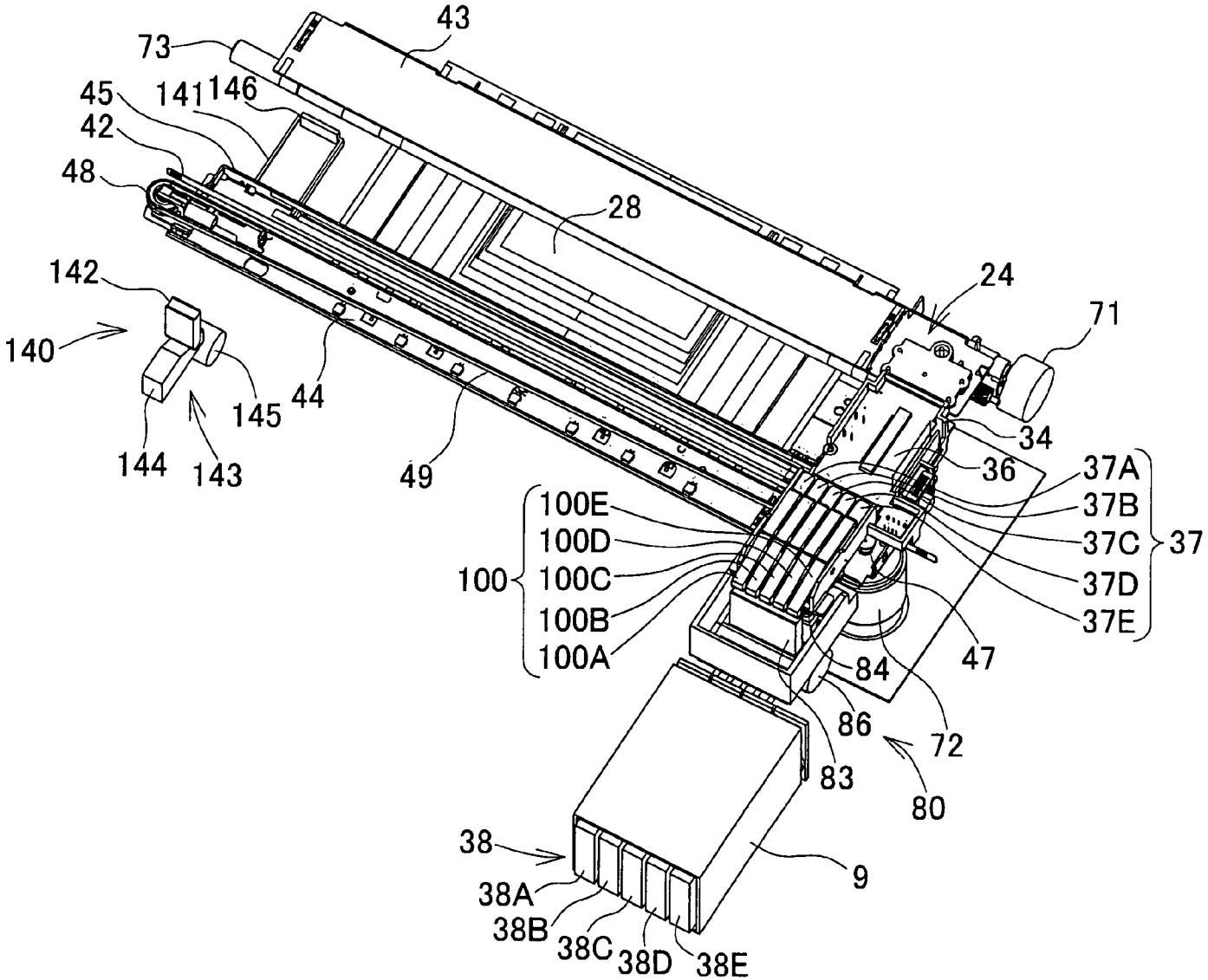
FIG. 3 shows an oblique view of the printer unit.
Figure 4:
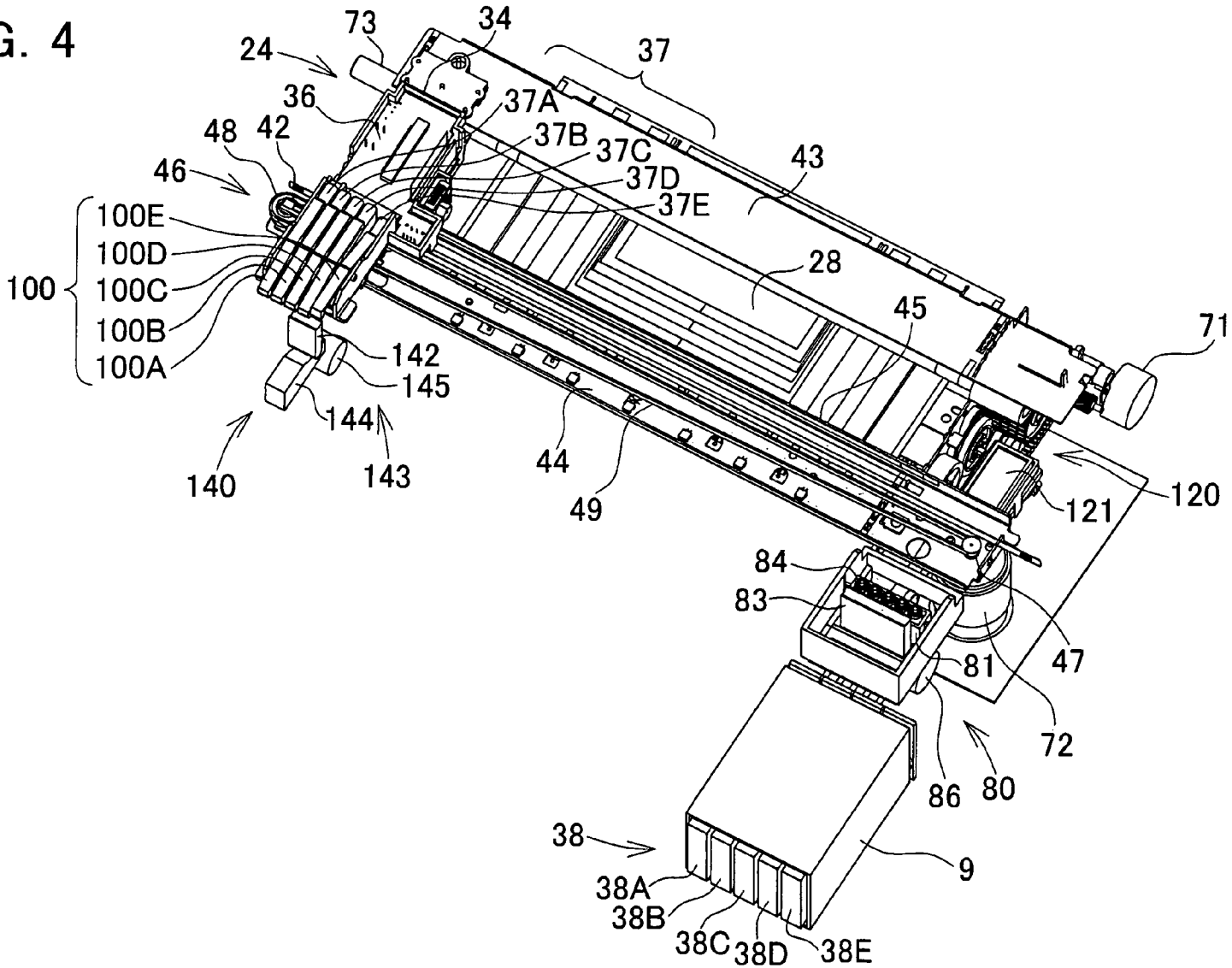
FIG. 4 shows an oblique view of the printer unit.
Figure 5:
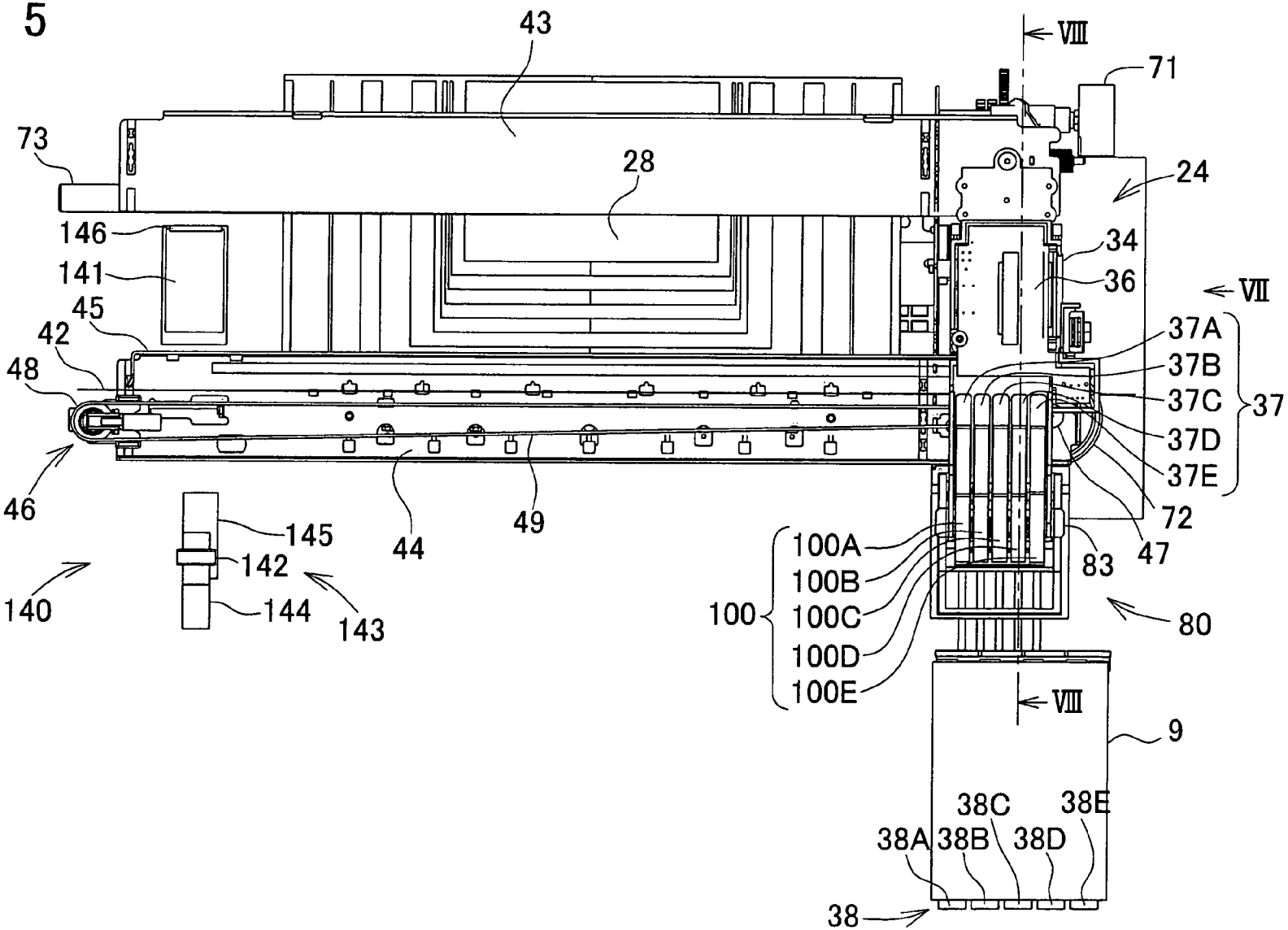
FIG. 5 shows a plan view of the printer unit.
Figure 6:
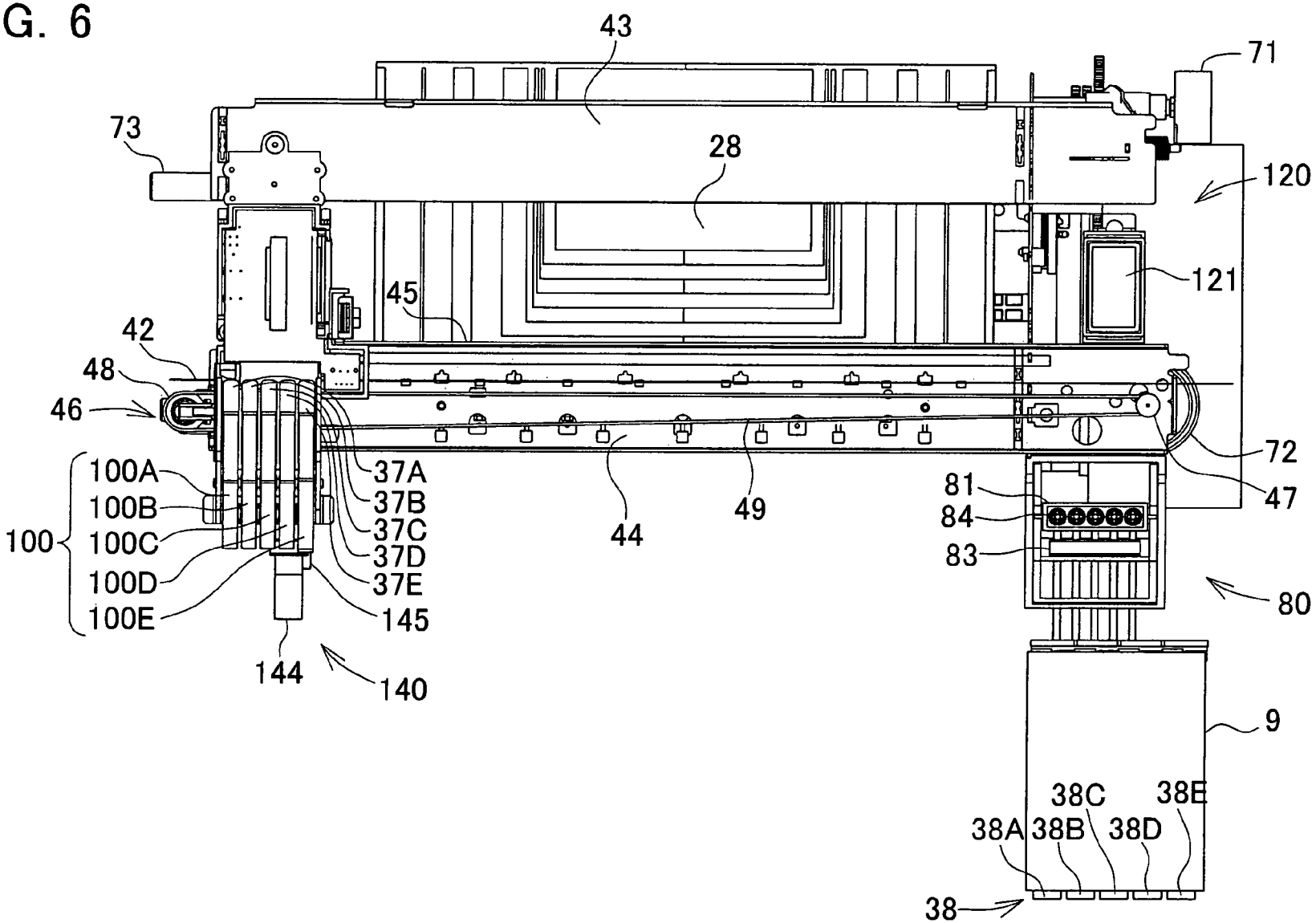
FIG. 6 shows a plan view of the printer unit.
Figure 7:
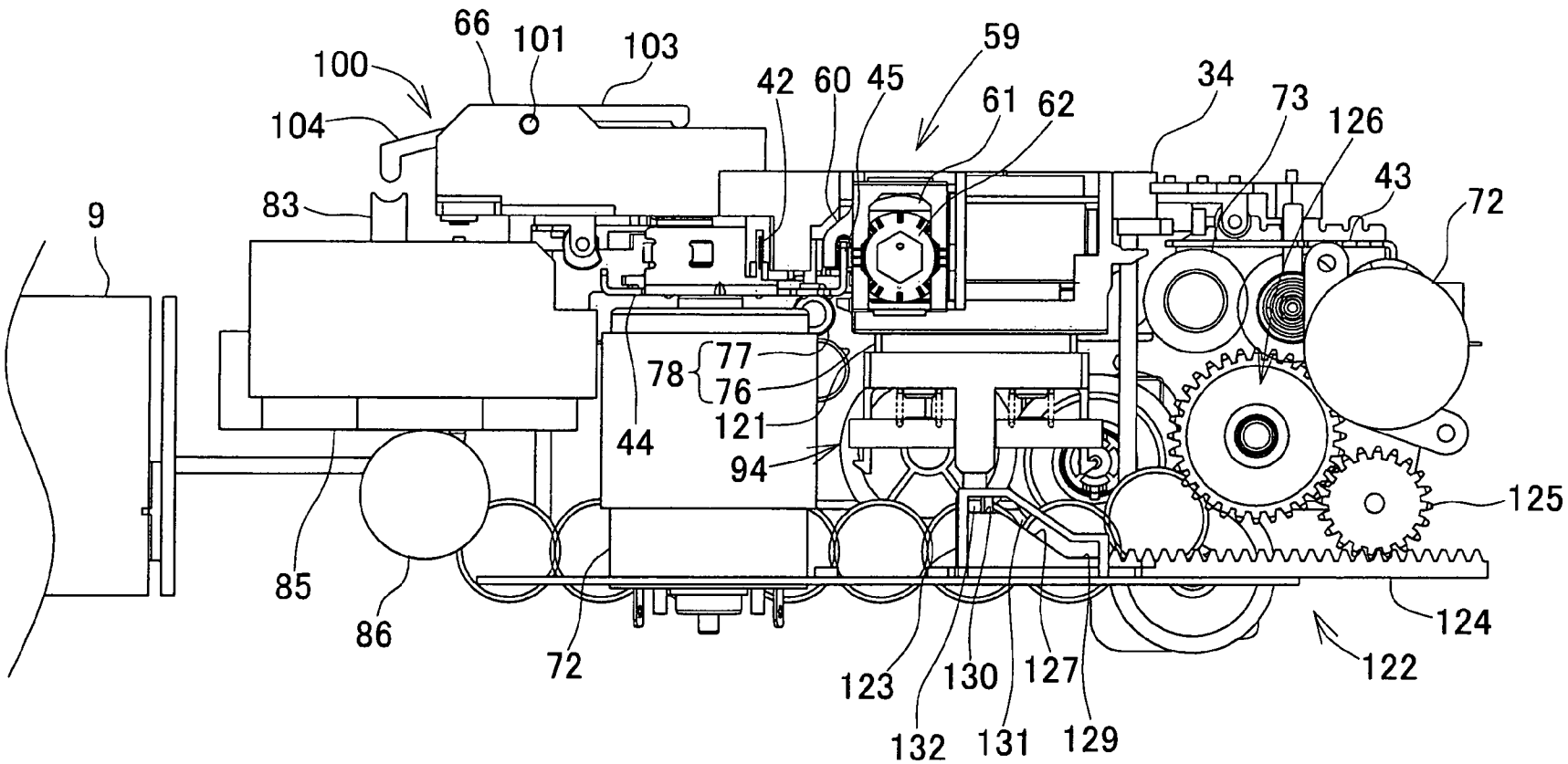
FIG. 7 is a view taken from the arrow VII direction of FIG. 5.
Figure 8:
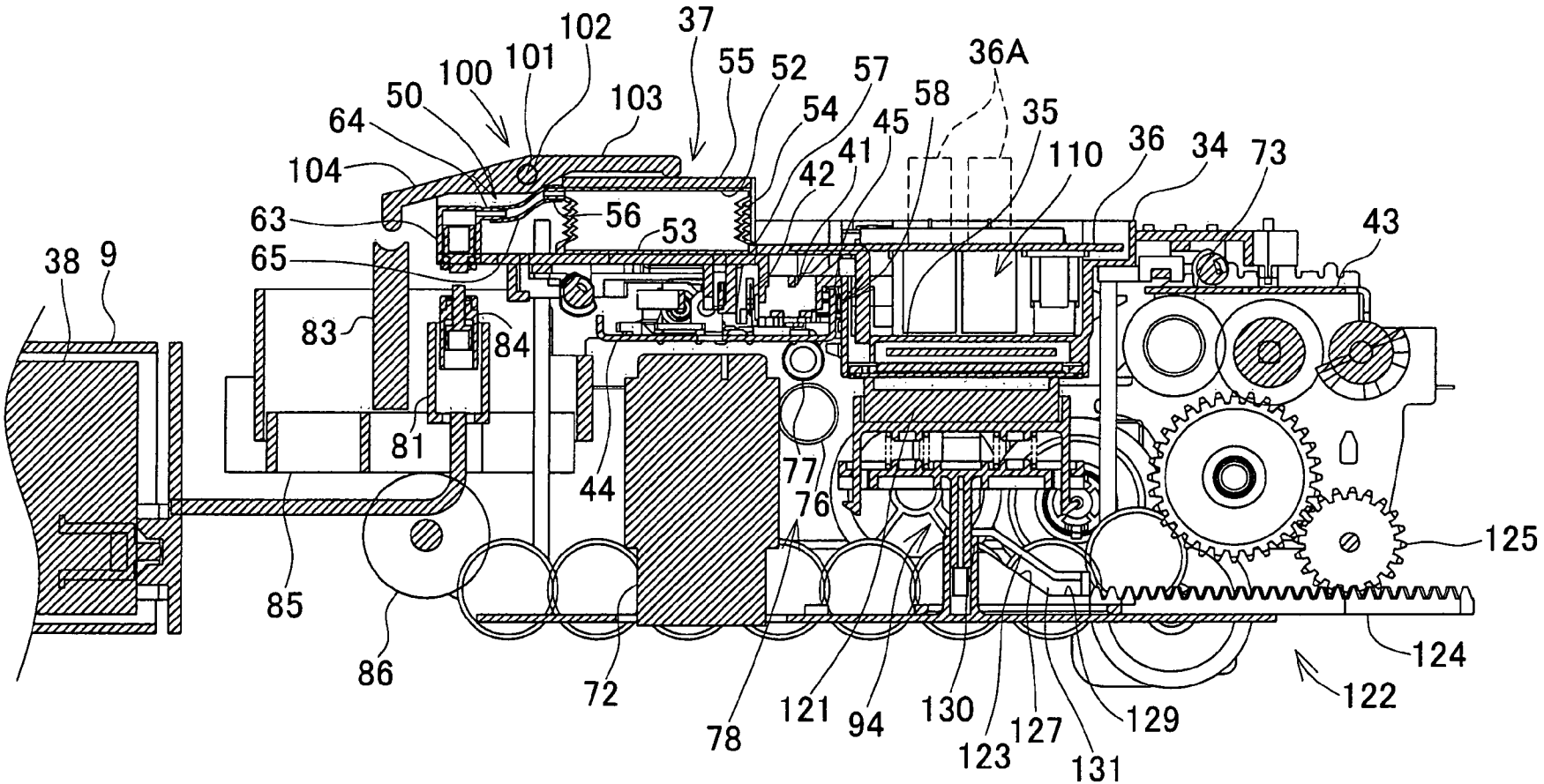
FIG. 8 shows the cross-sectional view of line VIII-VIII of FIG. 5.

FIG. 3 and FIG. 4 show an oblique view of the printer unit 2. FIG. 5 and FIG. 6 show a plan view of the printer unit 2. FIG. 3 and FIG. 5 show a state in which the image recording unit 24 is located in the ink supply position. FIG. 4 and FIG. 6 show a state in which the image recording unit 24 is located in the maintenance position. In addition, FIG. 7 is a view taken along the arrow VII direction of FIG. 5. FIG. 8 shows the cross-sectional view of line VIII-VIII of FIG. 5. Note that each of the aforementioned drawings shows a state in which a head cover that covers the upper surface of the carriage 34 has been removed.

As shown in each of the drawings, a pair of flat guide rails 43, 44 is arranged above the straight path 18 of the paper transport path 23 (see FIG. 2). Each guide rail 43, 44 extends in a direction (the horizontal direction of FIG. 5) orthogonal to the paper transport direction (the downward direction of FIG. 5). The guide rails 43, 44 are arranged across a predetermined distance in the paper transport direction (the downward direction of FIG. 5). The guide rail 43 is arranged on the upstream side in the paper transport direction, and the guide rail 44 is arranged on the downstream side in the paper transport direction. Although the guide rail 43 and the guide rail 44 have a slight step in the vertical direction, they are arranged in substantially the same plane. The upper surface of each guide rail 43, 44 is set so as to be parallel with the printing sheets being transported. Because the printing sheets are horizontally transported above the platen 28, the guide rails 43, 44 are also set to be horizontal with the upper surface.

The guide rails 43, 44 are arranged inside the casing 8, and function as a frame that supports each structural element that forms the printer unit 2. The guide rails 43, 44 support the carriage 34. The carriage 34 is capable of moving along the guide rails 43, 44 in a direction orthogonal to the paper transport direction (the direction in which the guide rails 43, 44 extend). More specifically, the end of the carriage 34 on the upstream side in the paper transport direction is supported by the guide rail 43 via a POM (polyacetyl resin) slide member or the like. In addition, the portion of the carriage 34 on the downstream side in the paper transport direction is supported by the guide rail 44 via the aforementioned slide member. The carriage 34 is mounted on the guide rails 43, 44 so as to span the guide rail 43 and the guide rail 44. By arranging the guide rails 43, 44 across the paper transport direction, and horizontally aligning the guide rails 43, 44 in substantially the same plane, the height of the printer unit 2 can be reduced. The result is that a reduction in the thickness of the printer unit 2 can be achieved.

As shown from FIG. 3 to FIG. 6, the length of the guide rails 43, 44 in the horizontal direction is longer than the length of the platen 28 in the horizontal direction. Friction tape or grease is applied to the guide rail 43, 44. In this way, the sliding friction between the guide rails 43, 44 and the carriage 34 will be reduced.

The edge 45 of the guide rail 44 on the upstream side in the paper transport direction is curved upward (upward of the multi-function device 1) at an approximate right angle. The carriage 34 has a grasping portion 58 that grasps the edge 45 (see FIG. 8 and FIG. 10). In this way, the carriage 34 will be positioned on the guide rail 44. The carriage 34 can be accurately moved (slid) in a direction (the horizontal direction of FIG. 5) orthogonal to the paper transport direction. In other words, the carriage 34 will move reciprocally in a direction orthogonal to the paper transport direction, using the edge 45 of the guide rail 44 as a reference.

As shown in FIG. 7, the carriage 34 has an adjustment mechanism 59. The adjustment mechanism 59 adjusts the vertical posture of the carriage 34 with respect to the vertical plane of the edge 45. The adjustment mechanism 59 is arranged on one side surface of the carriage 34. The adjustment mechanism 59 has a block unit 60 and a dial type movement mechanism 61. The block unit 60 is capable of moving in the paper transport direction (the horizontal direction of FIG. 7) while grasping the edge 45. The block unit 60 will move in the paper transport direction when the movement mechanism 61 is operated. For example, when the dial 62 of the movement mechanism 61 is operated, an eccentric cam (not shown in the drawings) linked to the rotation shaft of the dial 62 will be driven. This results in the block unit 60 moving in the paper transport direction. Because the adjustment mechanism 59 is provided, the vertical posture of the carriage 34 with respect to the vertical plane of the edge 45 can be freely adjusted.

As shown in FIG. 3 to FIG. 6, a head drive mechanism 46 is arranged on the upper surface of the guide rail 44. The head drive mechanism 46 has a drive pulley 47, a driven pulley 48, and a timing belt 49. The drive pulley 47 is connected to the right end of the guide rail 44. The driven pulley 48 is connected to the left end of the guide rail 44. The timing belt 49 extends around the pulleys 47, 48. Gear teeth are arranged around the inner circumferential surface of the timing belt 49. The timing belt 49 is an endless ring. Note that the timing belt 49 may also be a belt having ends. In this case, both ends of the belt are fixed to the carriage 34. A CR motor (carriage motor) 72 is linked to the shaft of the drive pulley 47. The drive force of the CR motor 72 is transmitted to the drive pulley 47. In this way, the drive pulley 47 will rotate, and the timing belt 49 will circulate between the drive pulley 47 and the driven pulley 48.

The bottom surface of the carriage 34 is fixed to the timing belt 49. Thus, the carriage 34 will reciprocally move on the guide rails 43, 44 based upon the circulation of the timing belt 49. The head 35 is mounted on the carriage 34. Because of this, the head 35 will reciprocally move in the width direction of the paper transport path 23 (the direction orthogonal to the paper transport direction) as the primary scanning direction.

An encoder strip 42 is arranged on the guide rail 44. The encoder strip 42 is a belt-shaped object comprised of a transparent resin. Both ends of the encoder strip 42 are supported by both ends in the width direction of the guide rail 44 (the reciprocating direction of the carriage 34).

A transparent portion that allows light to pass therethrough and a light blocking portion that blocks light are alternately arranged at a predetermined pitch on the encoder strip 42. A transmission type optical sensor 41 (see FIG. 8) is provided on the carriage 34. The optical sensor 41 detects the pattern of the encoder strip 42 during the reciprocal movement of the carriage 34. The head 35 mounted on the carriage 34 has a head control board 36 (described below). The head control board 36 outputs pulse signals in response to the detection signals of the optical sensor 41. After receiving the pulse signals, the controller of the multi-function device 1 will determine the position and speed of the carriage 34, and control the reciprocating movement of the carriage 34.

Figure 9:
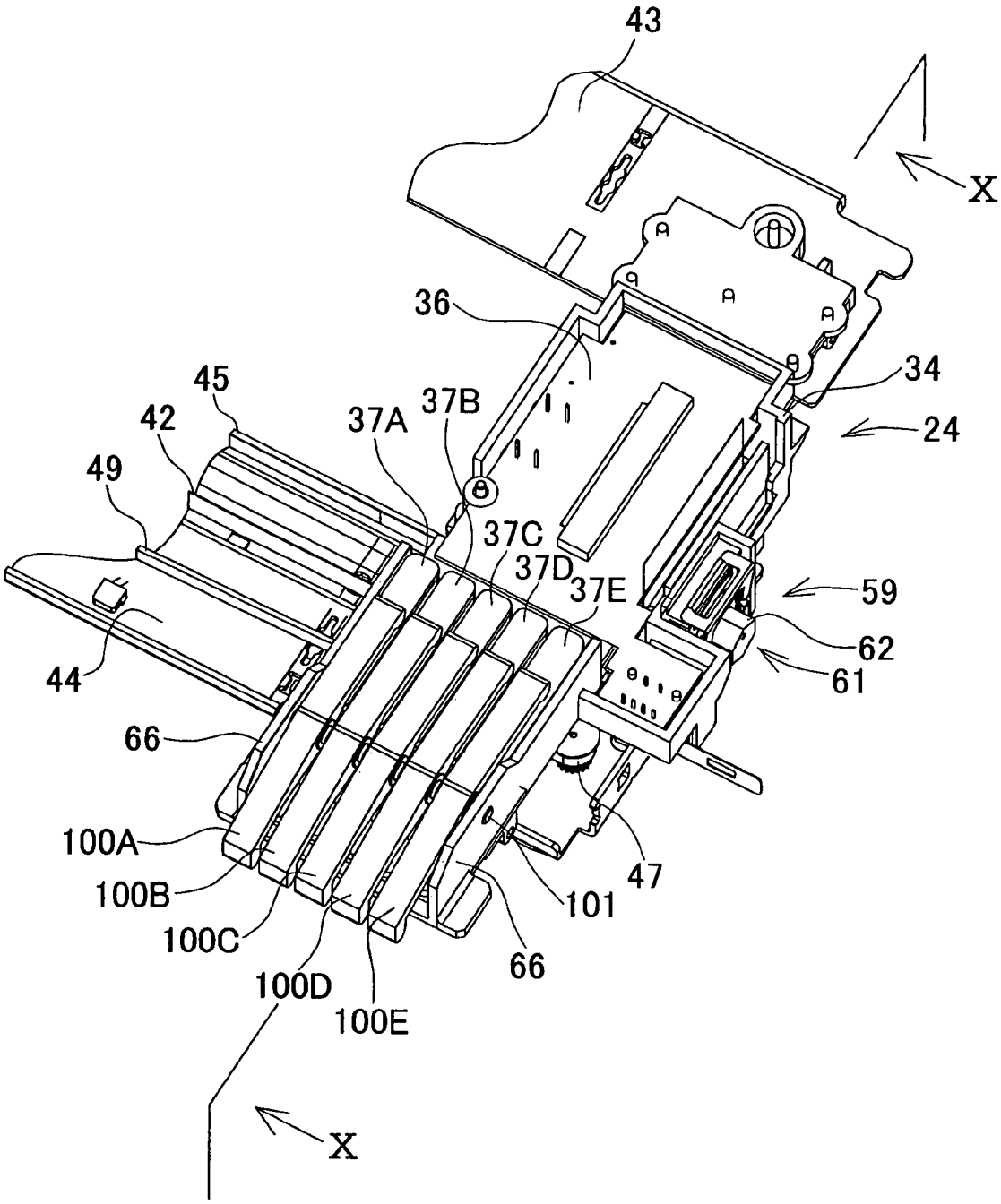
FIG. 9 shows an oblique view of an image recording unit.
Figure 10:
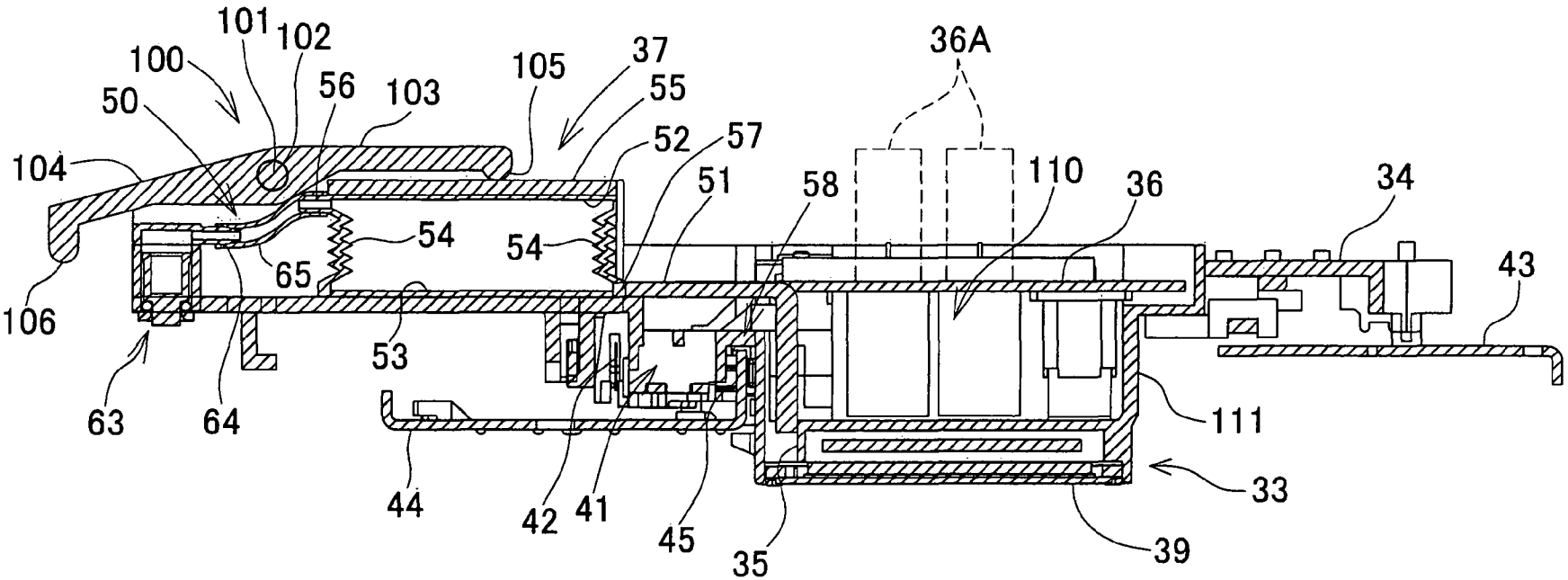
FIG. 10 shows the cross-sectional view of line X-X of FIG. 9.

FIG. 9 shows an enlarged oblique view of the image recording unit 24. In addition, FIG. 10 shows the cross-sectional view of line X-X of FIG. 9. Note that the line X-X of FIG. 9 passes through the center of the sub tank 37D. As noted above, the image recording unit 24 has the carriage 34, the head 35, the sub tanks 37, and the like. The construction of the image recording unit 24 will be described in detail below.

As shown in FIG. 10, the carriage 34 has a rectangular shape that is long in the front to rear direction of the multi-function device 1. A tank storage chamber 50 that serves to house the sub tanks 37 is provided on the downstream side of the central portion of the carriage 34 (the left side in FIG. 10) in the paper transport direction. The sub tanks 37 have a rectangular shape that is horizontally long when viewed from the side surfaces thereof. The lengthwise direction of the sub tanks 37 is the same as the transport direction of the print media. In the present embodiment, five sub tanks 37 (37A to 37E) corresponding to the five colors of ink used in the printer unit 2 are housed in the tank storage chamber 50. The five sub tanks 37 (37A to 37E) are aligned in the horizontal direction of the carriage 34 (the direction in which the guide rails 43, 44 extend). Each sub tank 37 has a rectangular shape that is long in the lengthwise direction of the carriage 34 (the horizontal direction of FIG. 10).

As noted above, the pair of paper discharge rollers 78 are arranged on the immediate downstream side of the head 35 (see FIG. 2, FIG. 7 and FIG. 8). Thus, if the sub tanks 37 are to be temporarily placed above the pair of paper discharge rollers 78, the sub tanks 37 must be placed significantly above the pair of paper discharge rollers 78 so as to not interfere with them. In this case, the thickness of the image recording unit 24 will increase. Because of this, in the present embodiment, as shown in FIG. 8, the sub tanks 37 are arranged on the downstream side of the pair of paper discharge rollers 78 in the paper transport direction. In this way, the sub tanks 37 will not interfere with the paper discharge rollers 78. The sub tanks 37 and the pair of paper discharge rollers 78 overlap in the height direction of the multi-function device 1. In this way, the thickness of the image recording unit 24 can be reduced.

The curved path 17 is arranged on the upstream side of the head 35 in the paper transport direction. Because of this, it is difficult to arrange the sub tanks 37 on the upstream side in the paper transport direction. Thus, the sub tanks 37 are arranged on the downstream side of the head 35 in the paper transport direction. In this case, the path between the ink cartridges 38 arranged on the front side of the multi-function device 1 and the sub tanks 37 can also be shortened. Note that in the present embodiment, the sub tanks 37 are arranged on the downstream side of the head 35 in the paper transport direction, but the sub tanks 37 may also be arranged on the upstream side of the head 35 in the paper transport direction (the upstream side of the pair of transport rollers 75 in the paper transport direction). In addition, regardless of whether the sub tanks 37 are on the upstream side or the downstream side of the head 35, the sub tanks 37 may also be arranged on the sides of the head 35 (the sides in the reciprocating direction of the carriage 34).

As shown in FIG. 10, the sub tanks 37 are arranged above the guide rail 44. The sub tanks 37 and the guide rail 44 overlap in the plan view of the multi-function device 1. The load of the sub tanks 37 is received by the guide rails 44 via the bottom surface 53 of the sub tank 37 and the support portion of the carriage 34. The result is that shifting (deforming) of the position of the carriage 34 caused by the load of the sub tanks 37 can be prevented. Smooth movement of the carriage 34 and optimal printing can be achieved.

The sub tanks 37 temporarily store ink that is supplied from the ink cartridges 38 (see FIG. 3). The sub tanks 37 are arranged further upstream of an ink supply passage 51 than the head 35. In other words, the sub tanks 37 are arranged above the discharge tray 11. From the plan view of the multi-function device 1, the discharge tray 11 and the sub tanks 37 overlap. Ink inside the sub tanks 37 is supplied to the head 35 via the ink supply passage 51 described below. Supply of the ink from the ink cartridges 38 to the sub tanks 37 is performed by the ink supply mechanism described below. When ink supply is performed by the ink supply mechanism 80, air bubbles will be generated in the passage between the ink cartridge 38 and the sub tank 37. The air bubbles are captured by the sub tanks 37. Because of this, the air bubbles can be prevented from entering the head 35 (the cavities 115 and the manifolds 116 described below).

The sub tanks 37 each have an upper surface 52, a bottom surface 53, and side surfaces 54. The upper surface 52 and the bottom surface 53 are each flat. The side surfaces 54 have a bellows shape along the entire circumference thereof. The sub tanks 37 are comprised of synthetic resin. For example, each of the aforementioned portions can be formed by means of blow molding. Because the side surfaces 54 are formed in a bellows shape, the side surfaces 54 are capable of expanding and contracting in the vertical direction. If an external force is applied in the vertical direction with respect to the sub tanks 37, the side surfaces 54 will contract or expand from their original shape. When the external force is eliminated, the side surfaces 54 will return to their original shape. In other words, the sub tanks 37 are capable of elastic deformation. For example, when the sub tanks 37 are pushed downward, the side surfaces 54 will contract. When the pushing force is eliminated, the side surfaces 54 will return from the contracted state to their original shape. Note that a plate 55 that covers the upper surface 52 of each sub tank 37 is provided on the upper side of the upper surface 52. The plate 55 is comprised of a metal plate or a thick resin plate. The upper surface 52 of each sub tank 37 is protected by the plate 55. In the present embodiment, the side surfaces 54 are formed into a bellows shape as a means of achieving the elastic deformation of the sub tanks 37. Thus, for example, the side surfaces 54 may also be formed from an elastic material such as rubber or the like. However, by forming the side surfaces 54 into a bellows shape, sub tanks 37 that will compress only in the vertical direction can be easily constructed. In addition, the sub tanks 37 can be stably compressed compared to when the side surfaces 54 are constructed of rubber or the like. Thus, the side surfaces 54 are preferably constructed into a bellows shape.

The sub tanks 37 can store the average amount of ink consumed in one print process. In the present embodiment, the volume of each sub tank 37 is set so as to store about 0.5 to 1.0 (ml). Because of this, the load on the carriage 34 can be lessened, and the burden on the CR motor 72 that reciprocally moves the carriage 34 can be reduced. Note that the volume of the sub tanks 37 may be changed in accordance with need. The sub tanks 37 may also store more or less than the aforementioned amount of ink.

As shown in FIG. 10, the sub tanks 37 each have two through holes 56, 57. One of the through holes 56 is provided in the front end (the left end of FIG. 10) of the upper surface 52 of each sub tank 37. The other through hole 57 is provided in the rear end (the right end of FIG. 10) of the bottom surface 53. In addition, a female joint 63 is provided on the left side of each sub tank 37. The female joints 63 are arranged on the front end of the tank storage chamber 50. The female joints 63 are linked with the ink cartridges 38 (see FIG. 3). Note that because there are five sub tanks 37, there are five female joints 63. A coupling 64 is connected to each female joint 63. The couplings 64 and the through holes 56 are connected by flexible tubes 65. Ink passages are formed between the female joints 63 and the sub tanks 37.

In contrast, each through hole 57 is connected to one end of the ink supply passage 51 that supplies ink to the head 35. Each ink supply passage 51 has a first portion that extends horizontally rightward from each through hole 57, and a second portion that extends downward from the right end of the first portion. The lower end of the second portion extends to the bottom surface of a head storage chamber 110 described below. The lower end of the second portion is linked to the head 35. For example, each ink supply passage 51 can be constructed by covering a groove formed in a synthetic resin plate member with a thin film. In addition, each ink supply passage 51 can also be constructed by means of a flexible tube.

Arms 100 that receive an external force and push each aforementioned plate 55 downward are provided above the tank storage chamber 50. A shaft hole 102 is formed in the approximate central portion of each arm 100. A shaft 101 that extends between the aforementioned pair of side walls 66 is inserted into the shaft holes 102. The arms 100 are pivotably supported by the shaft 101. Because there are five sub tanks 37 (37A to 37E) in the present embodiment, there are 5 arms 100 (100A to 100E).

Each arm 100 has a rearward arm 103 and a forward arm 104. The rearward arm 103 extends horizontally rearward from the shaft hole 102 (rightward in FIG. 10). The forward arm 104 extends horizontally forward from the shaft hole 102 (leftward in FIG. 10). The forward arm 104 extends forward past the front end of the carriage 34 (the left end of FIG. 10). A pressing portion 105 is on the tip of the rearward arm 103. Each pressing portion 105 comes into contact with each plate 55. Each pressing portion 105 transmits the drive force of each arm 100 to each plate 55. Each pressing portion 105 is formed to have a spherical surface. In this way, force can always be applied in the vertical direction with respect to each plate 55. In addition, an input portion 106 that receives external force from a push rod 83 described below (see FIG. 4) is provided on the front end of each forward arm 104. The contact surface of each input portion 106 is also formed to have a spherical surface. When an external force is applied to each input portion 106 from below, each arm 100 will pivot clockwise around the shaft 101. In this way, the rearward arms 103 will be pushed downward, and the pressing portions 105 will come into contact with the plates 55. The pressing force will be applied to the plates 55, and the side surfaces 54 of each sub tank 37 will contract.

A head storage chamber 110 for housing the head 35 is provided on the upstream side of the sub tanks 37 in the paper transport direction (further upstream in the paper transport direction than the central portion of the carriage 34; the right side of FIG. 10). The sub tanks 37 and the head storage chamber 110 are aligned in the paper transport direction. In other words, the sub tanks 37 and the head storage chamber 110 overlap in the height direction of the multi-function device 1. The sub tanks 37 and the head storage chamber 110 are completely offset in the plan view of the multi-function device 1. A concave portion 11 provided in the carriage 34 defines the head storage chamber 110. The concave portion 111 extends downward from the same surface as the bottom surface of the tank storage chamber 50. The head 35 is arranged on the bottom portion of the concave portion 111. The lower surface (the nozzle surface) of the head 35 is below the sub tanks 37. Because of this, the fluid levels of the ink stored in the sub tanks 37 are always located higher than the nozzle surface of the head 35.

The head 35 has a passage unit 37, a head control board 36, and the like. A plurality of nozzles 39 is formed in the passage unit 37. Each nozzle 39 selectively discharges ink droplets toward the printing sheets transported through the straight path 18 (see FIG. 2). The discharge amount and discharge timing of the ink is controlled by the head control board 36. The head control board 36 has a variety of electronic components (condensers and the like) 36A. When the multi-function device 1 is seen in plan view, the sub tanks 37 and the head 35 are completely offset (i.e., do not overlap at all). In addition, the sub tanks 37 and the head 35 overlap in the height direction of the multi-function device 1. Note that in the present embodiment, the type of head 35 used is one which will discharge ink due to the deformation of piezoelectric elements 114 (see FIG. 12). However, for example, a type of head can also be used that will discharge ink by heating the ink to produce bubbles.

Figure 11:
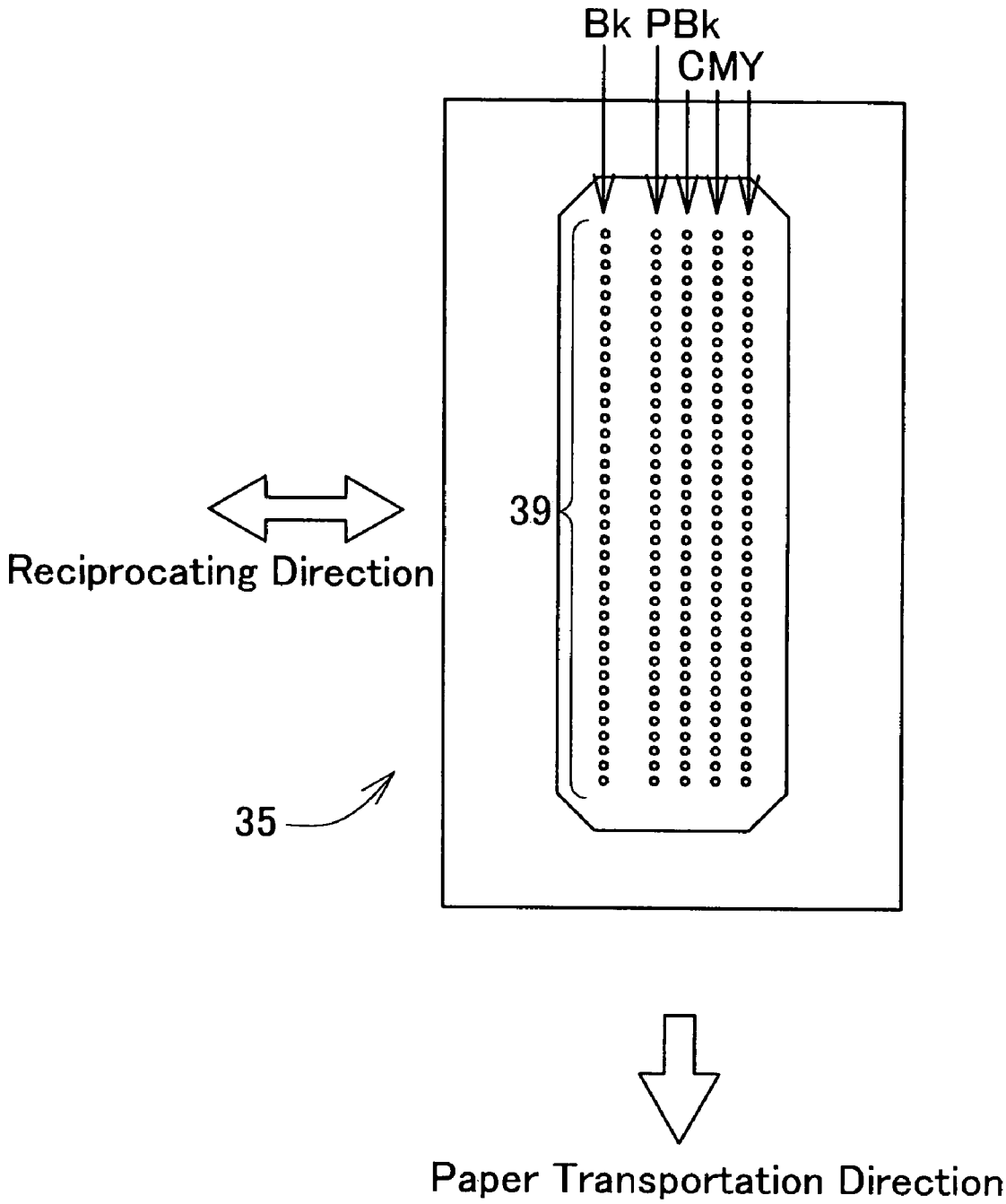
FIG. 11 shows a nozzle surface of the ink jet head.

FIG. 11 shows the nozzle surface of the head 35. Five rows of nozzles aligned in the horizontal direction are formed in the nozzle surface. Each row of nozzles is formed by aligning a plurality of nozzles in the paper transport direction. Each row of nozzles can discharge a different color of ink. Note that the horizontal direction of FIG. 11 is the reciprocating direction of the carriage 34. Note also that the pitch and number of the nozzles 39 in the transport direction is set in consideration of the resolution of the images and the like. In addition, the number of rows of nozzles can also be increased or decreased in response to the type and number of color inks.

Figure 12:
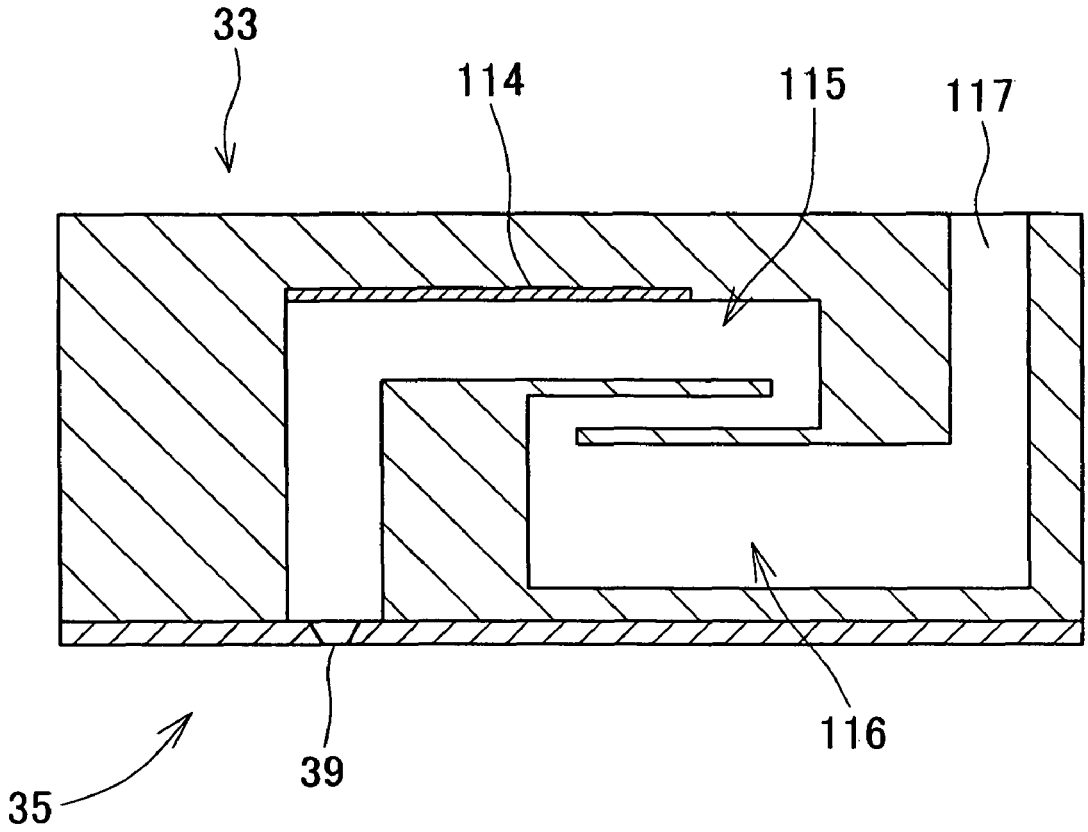
FIG. 12 shows a partial cross-sectional view of the ink jet head.

FIG. 12 shows the internal construction of the passage unit 33 in simplified form. The head 35 has piezoelectric elements 114. The piezoelectric elements 114 deform when a predetermined voltage is applied by the head control board 36. The passage unit 33 has a cavity 115. The cavity 115 communicates with the nozzle 39. When the piezoelectric element 114 deforms, the volume of the cavity 115 will change. In this way, energy will be applied to the ink inside the cavity 115, and the ink will be discharged from the nozzle 39.

One set comprising the cavity 115 and the piezoelectric element 114 is provided for each nozzle 39. In other words, the number of the aforementioned sets is equal to the number of nozzles. The passage unit 33 has a manifold 116. A plurality of cavities 115 communicate with the manifold 116. In the present embodiment, there are five manifolds 116 because five colors of ink are used. The passage unit 33 has an ink supply port 117. The ink supply port 117 communicates with the manifold 116. An ink supply passage 51 (see FIG. 10) is connected to the ink supply port 117. Thus, ink sent into the ink supply passage 51 is supplied to the manifold 116 from the ink supply port 117. Ink supplied from the ink supply port 117 to the manifold 116 is distributed to each cavity 115.

As noted above, the head 35 and the sub tanks 37 are mounted on the carriage 34. The carriage 34 moves reciprocally in a direction that is approximately orthogonal to the transport direction of the print media (the width direction of the multi-function device 1). Ink will be supplied from the sub tanks 34 to the head 35. Ink will be discharged from the head 35 onto printing media transported from the rear surface side to the front surface side of the multi-function device 1 while the carriage 34 moves reciprocally. In this way, the desired images can be printed on printing sheets.

As shown in FIG. 3 to FIG. 6, an ink supply mechanism 80, a capping mechanism 120 (see FIG. 4 and FIG. 6), and a maintenance mechanism 140 are provided in an area in which printing sheets do not pass (outside the printing range of the head 35).

Figure 13A:
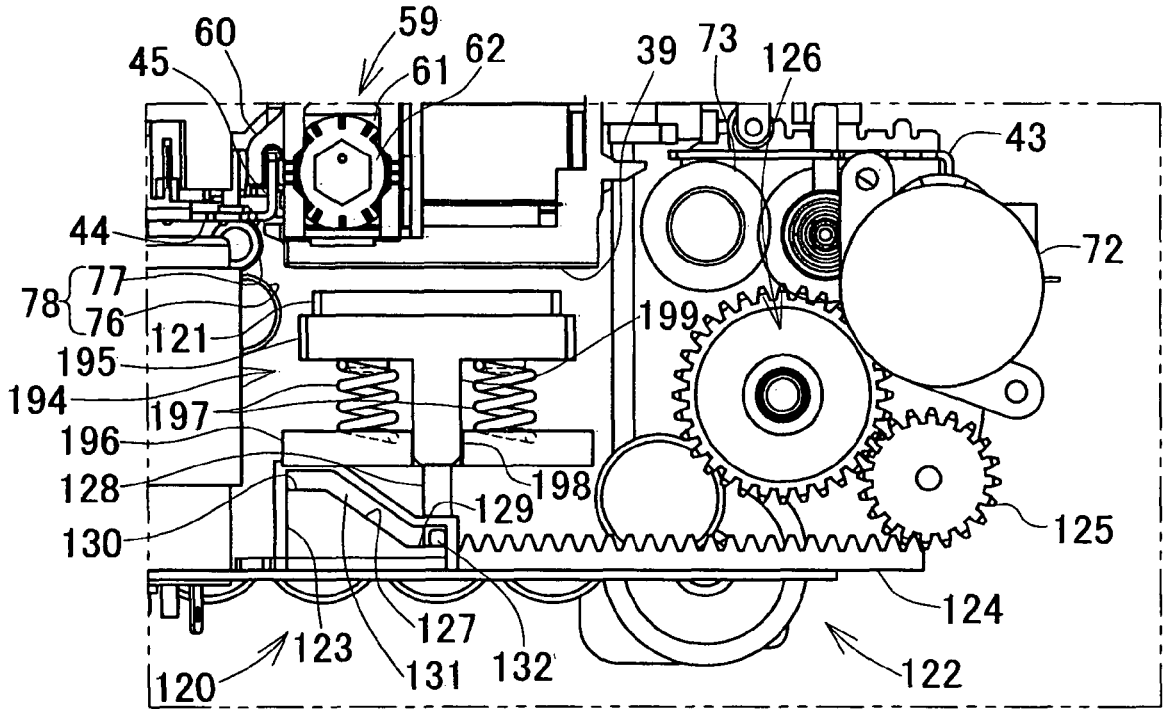
FIG. 13A shows a state where a cap is away the nozzle surface.
Figure 13B:
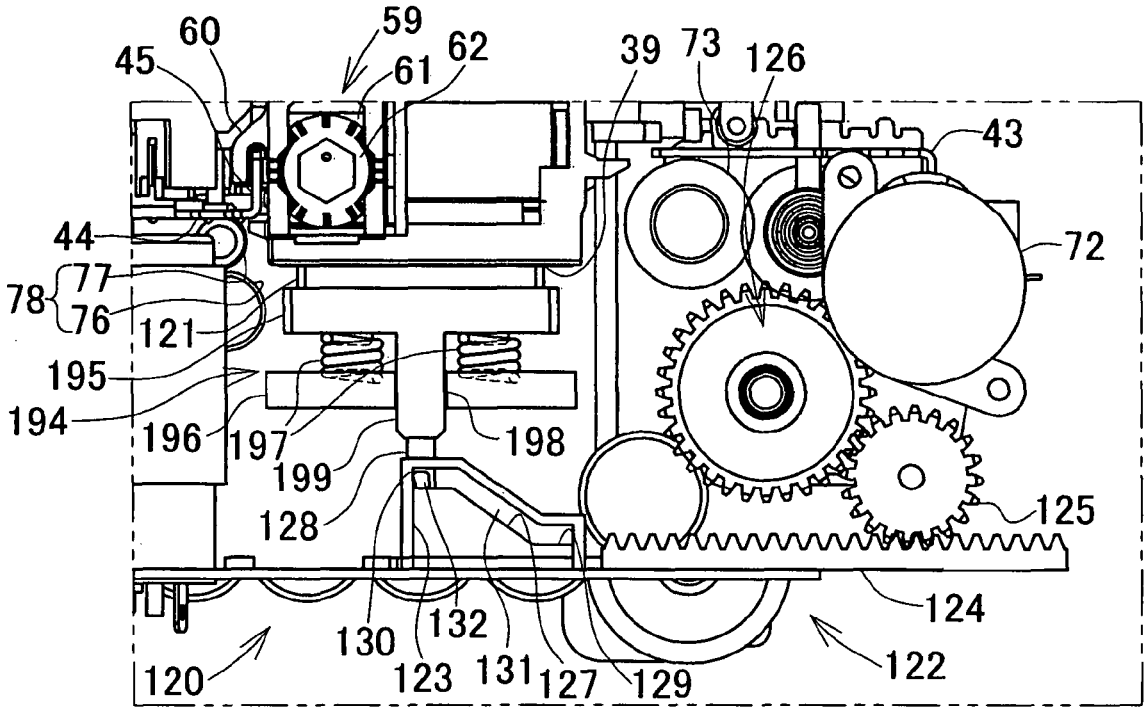
FIG. 13B shows a state where the cap makes contact with the nozzle surface.

First, the construction of the capping mechanism 120 will be described. The capping mechanism 120 is arranged adjacent to the right end of the range of movement of the head 35. FIG. 13 shows an enlarged view of the capping mechanism 120. FIG. 13A shows an uncovered state in which the nozzles 39 are not covered by a cap 121. FIG. 13B shows a covered state in which the nozzles 39 are covered by the cap 121. The capping mechanism 120 has the cap 121, a cap support portion 194, and a movement mechanism 122. The cap 121 is capable of covering the nozzles 39 of the head 35. The cap support portion 194 supports the cap 121. The movement mechanism 122 causes the cap support portion 194 to move and the cap 121 to come into contact with the nozzle surface of the head 35.

The movement mechanism 122 has a slide cam 123, a rack gear 124, a pinion gear 125, and a drive transmission mechanism 126. The slide cam 123 is arranged below the cap 121. The rack gear 124 causes the slide cam 123 to move in the front to rear direction of the multi-function device 1 (the horizontal direction of FIG. 13A and FIG. 13B). The pinion gear 125 meshes with the rack gear 124. The drive transmission mechanism 126 transmits the drive force of the LF motor 71 to the pinion gear 125. The pinion gear 125 is capable of moving in a direction perpendicular to the plane of FIG. 13. The movement of the pinion gear 125 is controlled by a drive means such as a solenoid (not shown in the drawings) or the like. The pinion gear 125 moves between a position in which it is meshed with the rack gear 124 and a position in which it is not meshed with the rack gear 124. The drive force of the LF motor 71 is transmitted to the rack gear 124 via the pinion gear 125 when the pinion gear 125 is meshed with the rack gear 124. In this way, the rack gear 124 will move in the front to rear direction of the multi-function device 1. Note that the rotational direction of the pinion gear 125 can be switched by using a planetary gear or the like and switching the gear arrangement of the drive transmission mechanism 126. In other words, the movement direction of the rack gear 124 can be switched between the front direction (the leftward direction of FIG. 13) and the rear direction (the rightward direction of FIG. 13). The slide cam 123 is linked to the rack gear 124. When the rack gear 124 moves, the slide cam 123 will also move. A groove 131 is formed in the slide cam 123. The groove 131 has an inclined surface 127 that inclines downward from front to rear, an upper flat portion 130 that extends leftward from the right end of the inclined surface 127, and a lower flat portion 129 that extends rightward from the lower end of the inclined surface 127.

The cap support portion 194 has a spring receptor 196, a coil spring 197, and a cap holder 195. The spring receptor 196 is supported by the frame or the like of the printer unit 2. The spring receptor 196 is capable of sliding in the vertical direction of FIG. 13. In other words, the spring receptor 196 can slide in a direction toward the nozzles 39 and in a direction away from the nozzles 39. A through hole 198 is formed in the spring receptor 196. The through hole 198 passes through the spring receptor 196 in the thickness direction (the vertical direction). A shaft 199 of the cap holder 195 is inserted into the through hole 198. A link bar 128 that extends downward is connected to the bottom of the spring receptor 196. A pin member 132 is connected to the lower end of the link bar 128. The pin member 132 is fitted into the groove 131. There is some looseness between the pin member 132 and the groove 131. The pin member 132 is capable of sliding between the lower flat portion 129 and the upper flat portion 130 of the groove 131. Note that the through hole 198 and the link bar 128 are shown to be overlapped in FIG. 13A and FIG. 13B. However, these are offset in the direction perpendicular to the plane of FIG. 13 in plan view.

The cap holder 195 holds the cap 121. The cap 121 is installed on the upper surface of the cap holder 195. The cap 121 is, for example, comprised of synthetic resin having flexibility. A cross-section of the cap 121 is U-shaped. The cap 121 has a tray shape. The bottom surface of the cap 121 is mounted on the upper surface of the cap holder 195. The cap holder 195 has the shaft 199 that extends downward from the approximate center of the bottom surface. The shaft 199 is inserted from above into the through hole 198 of the spring receptor 196.

There are coil springs 197 between the spring receptor 196 and the cap holder 195. The direction in which the coil springs 197 contract and expand is the vertical direction of FIG. 13. The cap holder 195 is supported by the coil springs 197. Note that in FIG. 13, only two coil springs 197 are shown. However, there are another two coil springs 197. In the present embodiment, there is a total of four coil springs. Because of this, the support of the cap holder 195 will be stable. Note that the arrangement and number of coil springs 197 can be changed.

When the pin member 132 is located in the lower flat portion 129 of the groove 131, the cap 121 is separated from the nozzle surface of the head 35 as shown in FIG. 13A. In other words, an uncovered state in which the nozzles 39 are not covered with the cap 121 will be achieved. When the rack gear 124 moves from the uncovered state to the rear of the multi-function device 1 (the right direction of FIG. 13), the pin member 132 will move from the lower flat portion 129 to the upper flat portion 130. In this way, the link bar 128 and the spring receptor 196 will rise, and the cap 121 will also rise. The cap 121 will come into contact with the nozzle surface of the head 35. When the spring receptor 196 moves further upward after the cap 121 is placed in contact with the nozzle surface, the coil spring 197 will be compressed. In this way, as shown in FIG. 13B, an urging force that strongly presses the nozzle surface of the head 35 is applied to the cap 121, and the cap 121 and the nozzle surface are attached to each other with no gap therebetween. In other words, the covered state in which the nozzles 39 are not covered with the cap 121 will be achieved. At this point, the space inside the cap 121 will be in a positive pressure state due to the cap 121 flexing by means of the aforementioned urging force. Because of this, the leakage of ink from the nozzles 39 can be prevented. In addition, when the rack gear 124 moves from the covered state of FIG. 13B in the forward direction of the multi-function device 1 (the left direction of FIG. 13), the spring receptor 196 will descend. Simultaneously with this, the coil springs 197 will gradually extend. When the spring receptor 196 descends further, the cap 121 will be separated from the nozzle surface of the head 35. When the decent of the spring receptor 196 is complete, the uncovered state shown in FIG. 13A will be achieved.

Next, the construction of the ink supply mechanism 80 will be described. As shown in FIG. 4 and FIG. 6, the ink supply mechanism 80 is arranged adjacent to the right end of the range of reciprocal motion of the carriage 34. The carriage 34 can move to the right end of the guide rails 43, 44 (the ink supply position). In this state, the ink supply mechanism 80 will supply ink from the ink cartridges 38 to the sub tanks 37. During ink supply, the nozzles 39 will be covered by the cap 121 by means of the capping mechanism 120. The ink supply mechanism 80 has a push rod 83, male joints 84, and a drive mechanism 82 (see FIG. 14).

The male joints 84 are linked with the female joints 63. In the present embodiment, there are five male joints 84 because there are 5 female joints. Each male joint 84 is connected to an ink tube that extends from each ink cartridge 38. Each male joint 84 is supported by a support block 81. Each male joint 84 is capable of sliding in a direction that approaches the female joint 63 (upward) and a direction away from the female joint (downward).

The push rod 83 applies force in the upward direction to the input portion 106 of the arms 100. The push rod 83 extends from the arm 100A to the arm 100E so as to be capable of applying force simultaneously upward to the five arms 100 (100A to 100E). The push rod 83 is arranged on the forward side of the male joints 84. The pushrod 83 is capable of sliding in the vertical direction.

Figure 14:
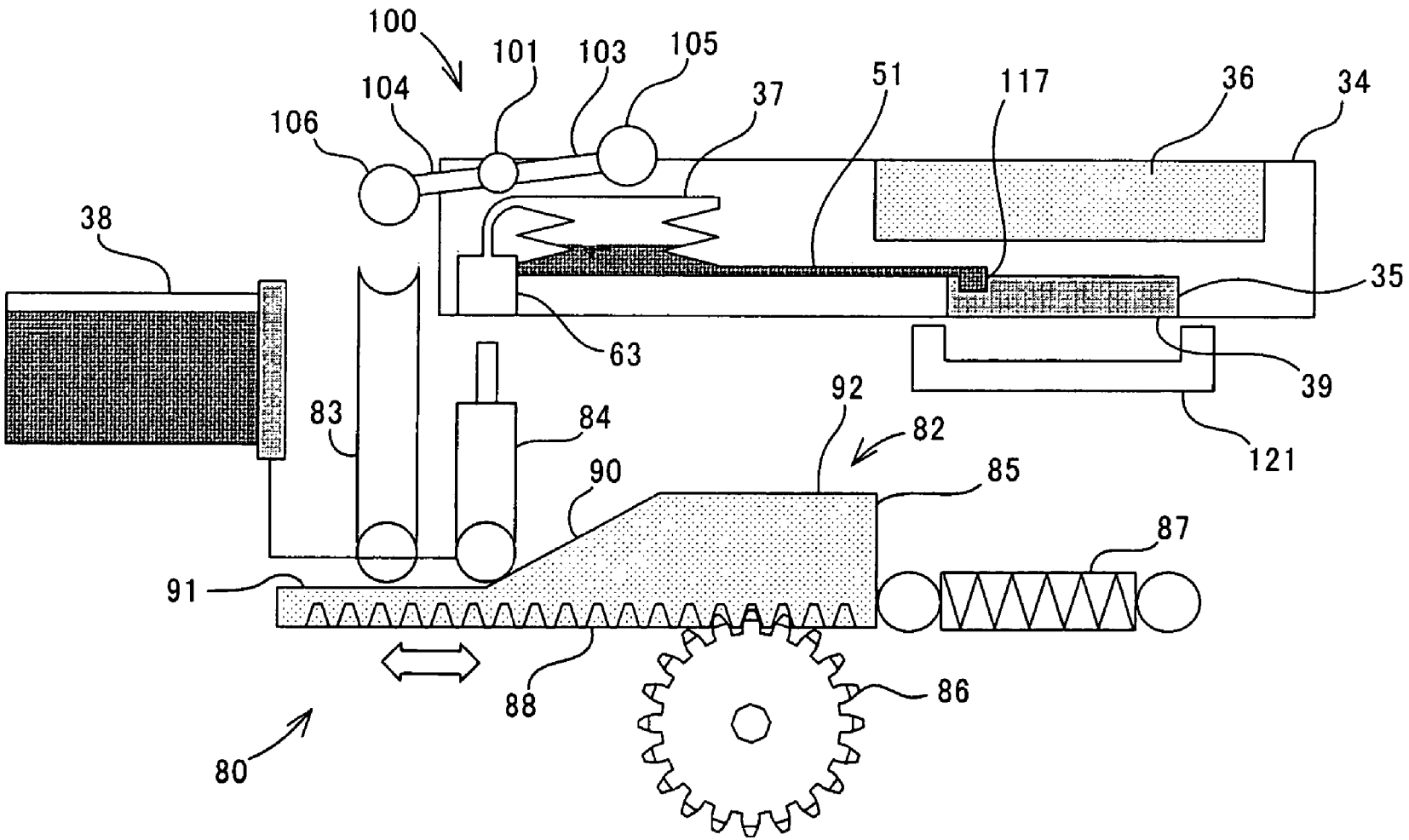
FIG. 14 shows a simple cross-sectional view of an ink supply mechanism.

FIG. 14 shows a simple cross-sectional view of the ink supply mechanism 80. The drive mechanism 82 has a slide cam 85, a pinion gear 86, and a coil spring 87. The slide cam 85 is arranged below the guide rail 44 (see FIG. 3). A rack gear 88 that meshes with the pinion gear 86 is formed on the bottom surface of the slide cam 85. The pinion gear 86 causes the slide cam 85 to slide in the forward and backward direction of the multi-function device 1 (the horizontal direction of FIG. 14). The pinion gear 86 is capable of moving in a direction perpendicular to the plane of FIG. 14. The movement of the pinion gear 86 is achieved by a solenoid or the like (not shown in the drawings). The pinion gear 86 is capable of moving between a position in which the rack gear 88 is meshed and a position in which the rack gear 88 is not meshed. The drive force of the LF motor 71 is transmitted to the pinion gear 86 when the pinion gear 86 is meshed with the rack gear 88. That drive force is transmitted to the slide cam 85 via the rack gear 88. In this way, the slide cam 85 will move in the forward direction of the multi-function device 1 (the left direction of FIG. 14). One end of the coil spring 87 is linked to the slide cam 85. The other end of the coil spring 87 is linked to the casing 8 or the like. The coil spring 87 will extend when the slide cam 85 moves forward. In other words, the coil spring 87 will urge the slide cam 85 rightward when the slide cam 85 has moved leftward.

The slide cam 85 has an inclined surface 90 that inclines forward from the rear, an upper flat portion 92 that extends rightward from the upper end of the inclined surface 90, and a lower flat portion 91 that extends leftward from the lower end of the inclined surface 90. The slide cam 85 is capable of moving between a position in which the slide cam 85 supports the support block 81 and the push rod 83 with the lower flat portion 91, and a position in which the slide cam 85 supports these with the upper flat portion 92. The push rod 83 is arranged to the left of the male joints 84. Thus, when the slide cam 85 moves from the state shown in FIG. 14, the male joints 84 will first come into contact with the inclined surface 90. In this way, the male joints 84 will rise, and the male joints 84 will be linked with the female joints 63. The result is that the ink passages will be formed between the ink cartridges 38 and the sub tanks 37. When the slide cam 85 moves further to the left, the pushrod 83 will come into contact with the inclined surface 90. In this way, the pushrod 83 will rise, and the pushrod 83 will push the input portions 106 upward.

Figure 15A:
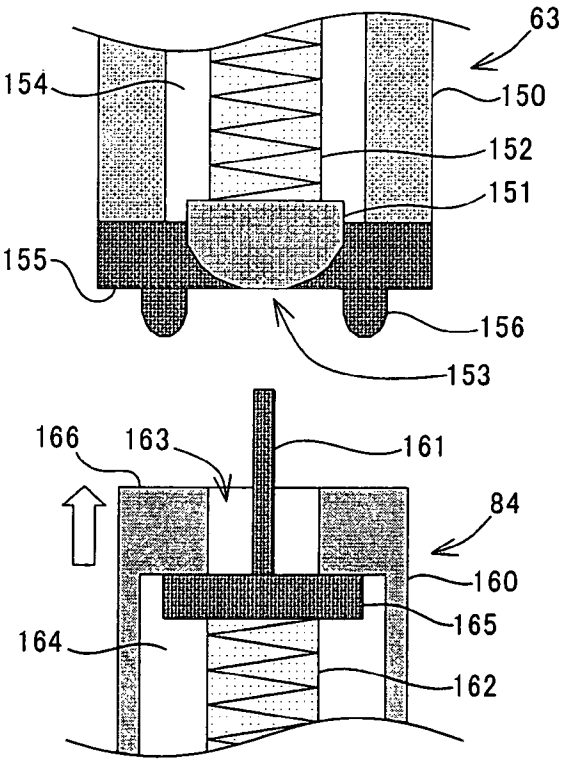
FIG. 15A shows the female joint and the male joint prior to being linked together.
Figure 15B:
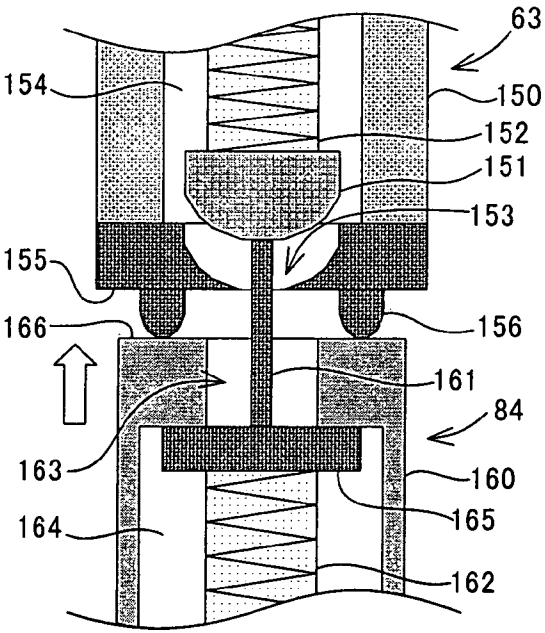
FIG. 15B shows the female joint and the male joint after having been linked together.
Figure 15C:
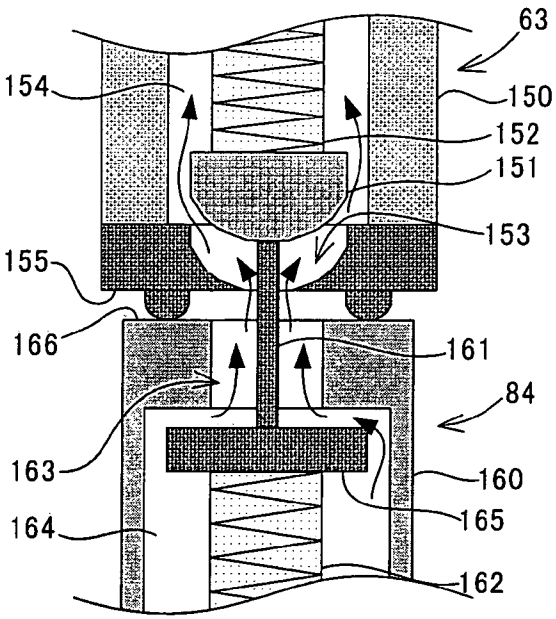
FIG. 15C shows a condition in which ink moves between the female joint and the male joint.

Next, the construction of the female joints 63 and the male joints 84 will be described in detail with reference to FIG. 15. Note that a portion of the female joints 63 and the male joints 84 is omitted in FIG. 15. Each female joint 63 has a joint main body 150, a plug member 151, and a coil spring 152. The joint main body 150 is formed into a tubular shape. The plug member 151 is capable of moving in the axial direction in the interior of the joint main body 150. The lower half of the plug member 151 has a ball shape. The coil spring 152 urges the plug member 151 downward. An interior space 154 of the joint main body 150 is an ink flow passage. Each interior space 154 communicates with the sub tank 37 via the coupling 64, the tube 65, and the through hole 56. A hole 153 in which the rod 161 of the male joint 84 is to be inserted is formed in the joint main body 150. The hole 153 is formed in a linking surface 155 that will link with the male joint 84. The hole 153 is closed by the plug member 151. The plug member 151 is capable of moving between a position in which the hole 153 is open and a position in which the hole 153 is closed. The coil spring 152 urges the plug member 151 toward the hole 153. The state in which the hole 153 is closed by the plug member 151 is maintained by the coil spring 152 (see FIG. 15A).

A seal member 156 is arranged on the linking surface 155 of the joint main body 150. The seal member 156 is formed so as to completely surround the hole 153. The seal member 156 will prevent ink from leaking to the outside when the female joint 63 and the male joint 84 are linked. The seal member 156 is constructed of, for example, nitrile rubber (NBR), silicone rubber (VMQ), or the like. The seal member 156 has flexibility, and will flex by means of a pressing force from the male joint 84.

The spring force of the coil spring 152 is set as follows. In other words, when the pressure inside the sub tank 37 is smaller than a predetermined negative pressure (back pressure) that is lower than atmospheric pressure, the coil spring 152 will not withstand the force that pushes the plug member 151 into the joint main body 150 and thus will be compressed. When the pressure inside the sub tank 37 has recovered to the aforementioned negative pressure or higher, the coil spring 152 will withstand the force that pushes the plug member 151 inside the joint main body 150 and thus will extend. When ink is discharged from the head 35, the barometric pressure inside the sub tank 37 will gradually decrease. In this case, when the barometric pressure inside sub tank 37 is less than the aforementioned predetermined negative pressure, the hole 153 will be opened and atmospheric air will flow into the sub tank 37 from the hole 153. When the barometric pressure inside the sub tank 37 recovers to the aforementioned negative pressure or higher, the hole 153 will be closed by means of the plug member 151. The pressure inside the sub tank 37 can be prevented from reaching the predetermined negative pressure or lower. In addition, if the temperature inside the sub tank 37 increases, the barometric pressure inside the sub tank 37 will increase. When the barometric pressure inside the sub tank 37 becomes higher than a predetermined value, air will leak to the outside from a slight gap between the plug member 151 and the joint main body 150 (the hole 153). This will be achieved because the plug member 151 is formed into the ball shape. The result is that the barometric pressure inside the sub tank 37 will be prohibited from becoming higher than the aforementioned predetermined value. In the present embodiment, the barometric pressure inside the sub tank 37 will be maintained within a predetermined range. The result is that the meniscuses of the nozzles 39 will always be maintained in an optimal state.

Each male joint 84 has a joint main body 160, a rod 161, and a coil spring 162. The joint main body 160 is formed into a tubular shape. The rod 161 is capable of moving in the axial direction in the interior of the joint main body 160. The coil spring 162 urges the rod 161 upward. An interior space 164 of the joint main body 160 is an ink flow passage. The interior space 164 communicates with the ink cartridge 38 via a tube not shown in the drawings. A hole 163 is formed in the joint main body 160. The hole 163 is formed in a linking surface 166 that will be linked with the male joint 63. The rod 161 is inserted into the hole 163. The rod 161 projects upward beyond the hole 163. The outer diameter of the rod 161 is set to be smaller than the inner diameter of the hole 163. Ink is capable of moving through the hole 163 even in a state in which the rod 161 is inserted into the hole 163.

A blocking member 165 that closes the hole 163 from the inside is connected to one end of the rod 161. The rod 161 is capable of moving between a position in which the hole 163 is closed with the blocking member 165 and a position in which the hole 163 is open. The coil spring 162 urges the blocking member 165 toward the hole 163. In this way, the hole 163 will be closed with the blocking member 165, and the rod 161 will be maintained in a state in which it projects out of the hole 163.

The spring force of the coil spring 162 is set as follows. In other words, the spring force of the coil spring 162 is set to be stronger than the coil spring 152 of the female joint 84. The spring force of the coil spring 162 is set such that when the rod 161 is in contact with the plug member 151 as shown in FIG. 15B, the coil spring 152 is compressed but the coil spring 162 is not compressed. In addition, the spring force of the coil spring 162 is set such that when the link surface 166 of the male joint 84 has come into contact with the seal member 156, the force relationship between the spring force of the coil spring 152 and the spring force of the coil spring 162 will be opposite. In other words, when the male joint 84 rises further upward from the state in which the link surface 166 of the male joint 84 is in contact with the seal member 156 (see FIG. 15B), the coil spring 162 will be compressed only the corresponding amount of flexibility in the seal member 156. In this way, the hole 163 in the male joint 84 will be opened. In other words, when the male joint 84 rises up, the hole 153 in the female joint 63 will be opened first. Next, the link surface 166 of the male joint 84 will be placed into contact with the seal member 156. Finally, the hole 163 in the male joint 84 will be opened.

Next, the ink supply operation performed by the ink supply mechanism 80 will be described. FIG. 16 is a drawing that serves to describe the ink supply operation. Note that in FIG. 16, the pinion gear 86 is omitted. In the present embodiment, the ink supply operation will be executed when the remaining quantity of ink inside the sub tank 37 is less than a predetermined quantity. The following construction may also be adopted in order to detect the remaining quantity of ink inside the sub tank 37. For example, when the sub tank 37 is transparent, an optical sensor such as a photointerrupter or the like will be arranged on the carriage 34. The controller can determine whether or not there is less than the predetermined quantity based upon the output of the optical sensor. In addition, the quantity of ink discharged may also be counted by a dot counter, and the remaining quantity of ink determined from that count value. The controller will cause the carriage 34 to move to the ink supply position (the position shown in FIG. 3 and FIG. 5) when the remaining quantity of ink is less than a predetermined quantity. In this case, the stop position of the carriage 34 will be controlled (see FIG. 16A) such that the nozzles 39 of the head 35 are located directly above the cap 121.

Next, the controller will drive the movement mechanism 122 (see FIG. 13), and will cause the cap 121 to rise. In this way, the cap 121 is attached to the lower surface of the head 35 (see FIG. 16B). Ink will not leak from the nozzles 39 during ink supply because the nozzles 39 are blocked. The controller will drive the drive mechanism 82 at the same time it causes the cap 121 to move. The controller will cause the pinion gear 86 (see FIG. 14) and the rack gear 88 of the slide cam 85 to mesh, and then apply the drive force of the LF motor to the slide cam 85. In this way, the slide cam 85 will move forward (the left direction of FIG. 16). The male joint 84 will be raised up by the inclined surface 90 of the slide cam 85. The male joint 84 will link with the female joint 63 (see FIG. 16B). In this way, ink passages will be formed between the ink cartridges 38 and the sub tanks 37.

Figure 16A:
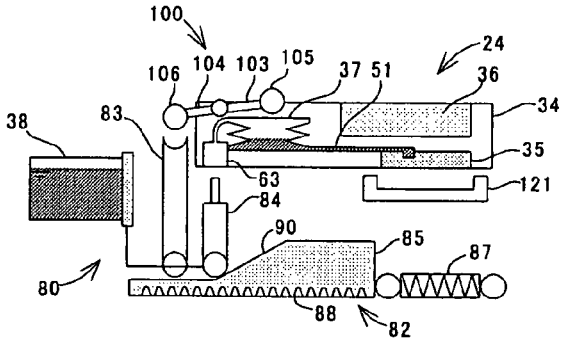
FIG. 16A shows a condition in which ink is supplied to a sub tank.
Figure 16B:
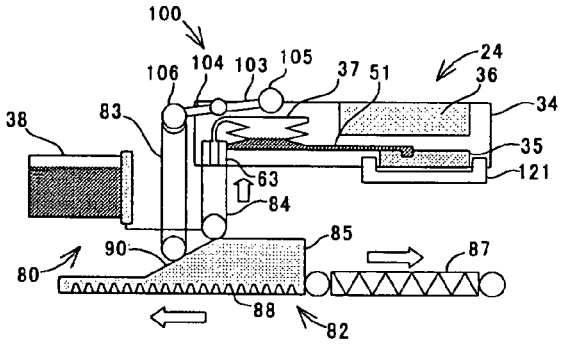
FIG. 16B shows a condition immediately prior to the sub tank being pushed.
Figure 16C:
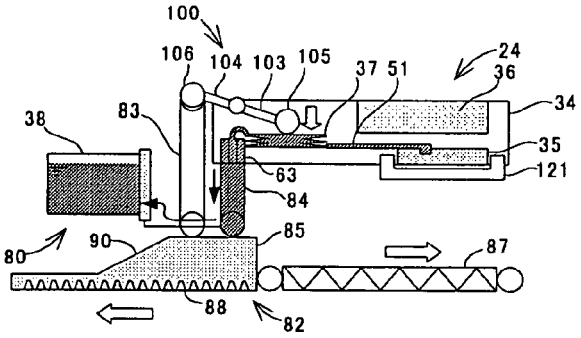
FIG. 16C shows a condition after the sub tank was pushed.
Figure 16D:
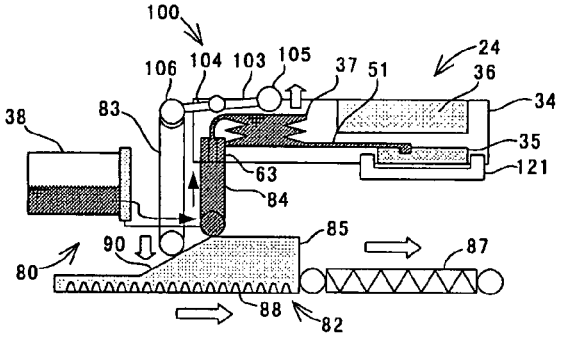
FIG. 16D shows the condition after the sub tank was returned.

The controller will cause the slide cam 85 to move further forward. The push rod 83 will be raised up by the inclined surface 90. At this point, a force that pushes the forward arm 104 upward to the input portion 106 of the arm 100 will be applied. The arm 100 will pivot due to this force. In this way, the pressing portion 105 of the rearward arm 103 will push the plate 55 of the sub tank 37 downward. The result is that, as shown in FIG. 16C, the sub tank 37 will be compressed, and the ink, air, etc. inside the sub tank 37 will move from the through hole 56 to the ink cartridge 38. Note that the ink will flow smoothly into the ink cartridge 38 due to the provision of an air ventilation hole in the ink cartridge 38.

When the ink inside the sub tank 37 has been almost completely exhausted, the controller will cause the slide cam 85 to move rearward (rightward in FIG. 16). The controller will release the meshing between the pinion gear 86 and the rack gear 88. In this way, the spring force of the coil spring 87 will be applied to the slide cam 85. The push rod 83 will descend along the inclined surface 90 of the slide cam 85. In this way, the pressing force applied to the sub tank 37 will be released at the same time that the push rod 83 moves away from the input portion 106 of the forward arm 104. The sub tank 37 will return to its original shape. At this point, as shown in FIG. 16D, the ink inside the ink cartridge 38 will move into the sub tank 37.

Figure 16E:
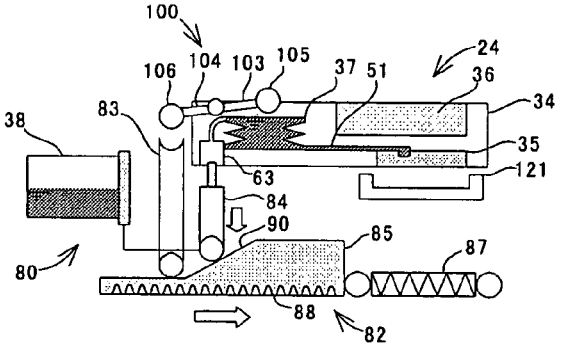
FIG. 16E shows the condition after ink was supplied to the sub tank.

When the slide cam 85 moves further rearward, the male joint 84 will descend (see FIG. 16E). In this way, the link between the male joint 84 and the female joint 63 will be released. At this point, a small quantity of air will come into the interior from the hole 153 of the female joint 63, and the sub tank 37 will expand. In this way, ink stored in the ink passage from the female joint 63 up to the through hole 56 will flow inside the sub tank 37. The ink inside the ink cartridge 38 will be supplied into the sub tank 37 in accordance with each of the aforementioned operations.

Next, the construction of the maintenance mechanism 140 will be described. As shown in FIG. 3 to FIG. 6, the maintenance mechanism 140 is arranged adjacent to the left end of the reciprocating range of the carriage 34. The carriage 34 can move to the left end of the guide rails 43, 44 (the maintenance position). In this state, maintenance on the head 35 will be performed (air discharge of ink such as positive pressure purge, flushing, or the like) by means of the maintenance mechanism 140. Sludge and air bubbles in the nozzles 39 of the head 35 and in the ink passages from the sub tanks 37 up to the nozzles 39 can be removed (purged) by performing maintenance. As shown in FIG. 3, the maintenance mechanism 140 has a wiper 146, an ink tray 141, a push rod 142, and a drive mechanism 143 that pushes the pushrod 142 upward.

The ink tray 141 is in the same plane as the upper surface of the platen 28. The ink tray 141 is arranged inside the reciprocating range of the carriage 34 and outside the printing range. Note that liquid adsorbent material such as felt or the like is arranged inside the ink tray 141. Ink that has been discharged will be adsorbed by the liquid adsorbent material. The wiper 146 that wipes off the nozzle surface of the head 35 is connected to the ink tray 141. A drive mechanism not shown in the drawings will cause the wiper 146 to slide in the front to rear direction when the wiper 146 has been pushed onto the head 35. In this way, ink adhered to the nozzle surface will be wiped off.

The push rod 142 pushes the input portion 106 of the arm 100 upward. The push rod 142 can push the input portion of one arm 100 selected from the five arms 100 (100A to 100E). The width of the push rod 142 is the same as the width of the input portion 106. The push rod 142 is capable of sliding in the vertical direction below the input portion 106.

Figure 17:
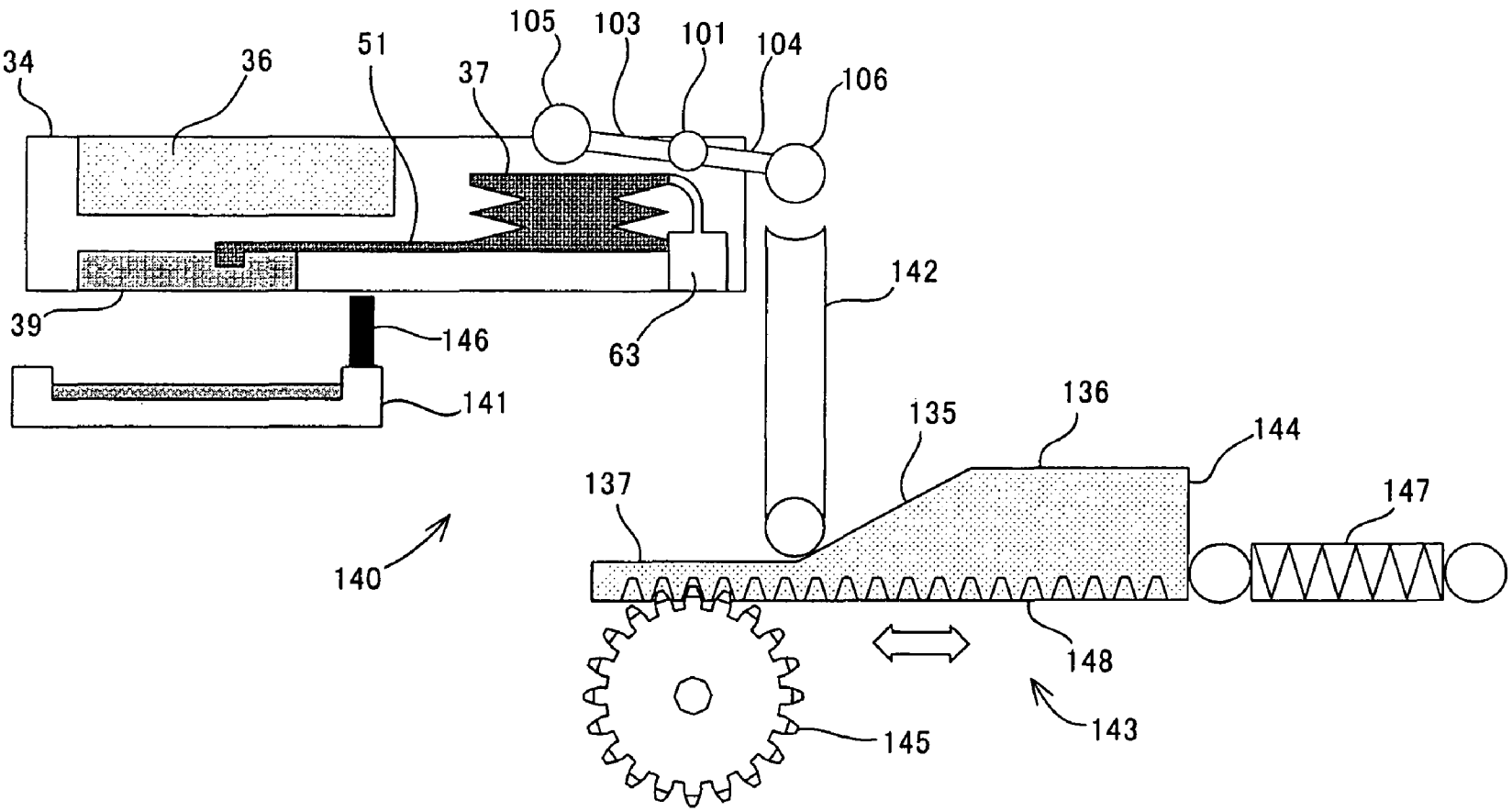
FIG. 17 shows a simple cross-sectional view of a maintenance mechanism.
Figure 18A:
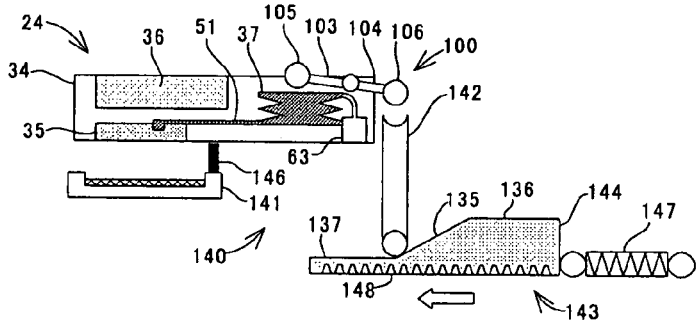
FIG. 18A shows a condition prior to maintenance being performed.
Figure 18B:
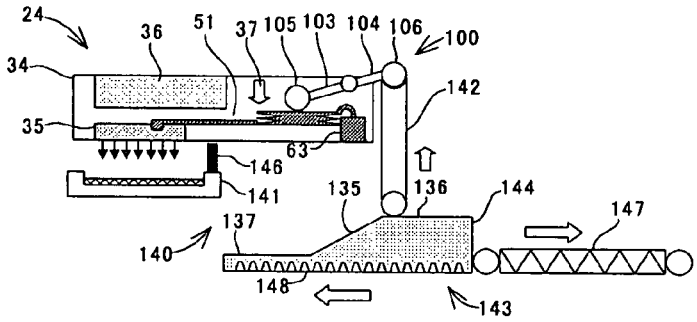
FIG. 18B shows a condition after the subtank was pushed.
Figure 18C:
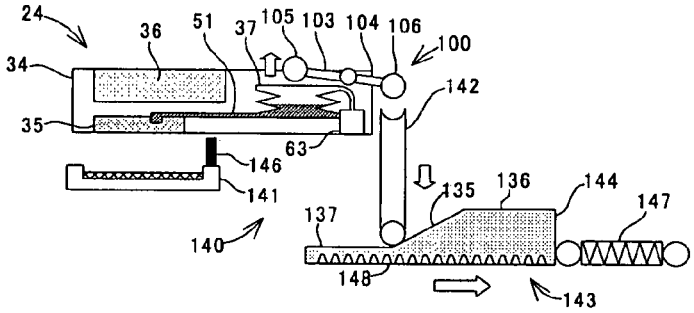
FIG. 18C shows a condition after the sub tank was returned.
Figure 18D:
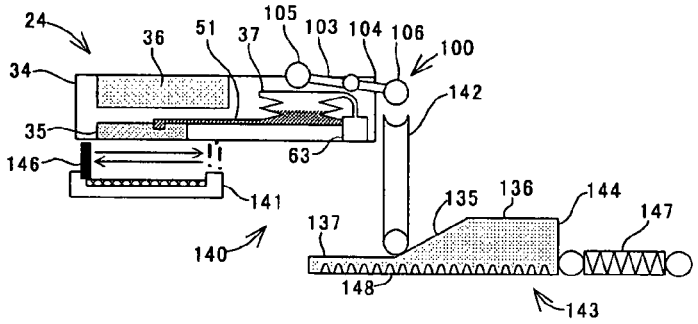
FIG. 18D shows a condition in which a wiper is moved.
Figure 18E:
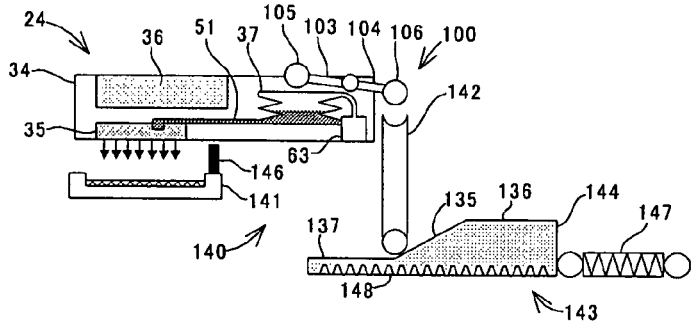
FIG. 18E shows a condition in which flushing is performed.

FIG. 17 shows a simple cross-sectional view of the maintenance mechanism 140. The drive mechanism 143 has a slide cam 144, a pinion gear 145, and a coil spring 147. The slide cam 144 is arranged below the guide rail 44 (see FIG. 3). The rack gear 148 that meshes with the pinion gear 145 is formed on the bottom surface of the slide cam 144. The pinion gear 145 causes the slide cam 144 to slide in the forward and backward direction (the horizontal direction of FIG. 17). The pinion gear 145 is capable of moving in the direction perpendicular to the plane of FIG. 17. This movement is achieved by a solenoid or the like (not shown in the drawings). The pinion gear 145 is capable of moving between a position in which the rack gear 148 is meshed and a position in which the pinion gear 145 is not meshed. The drive force of the LF motor 71 is transmitted to the pinion gear 145 when the pinion gear 145 is meshed with the rack gear 148. This drive force is transmitted to the slide cam 144 via the rack gear 148. In this way, the slide cam 144 will move rearward (the left direction of FIG. 17). One end of the coil spring 147 is linked to the slide cam 144. The other end of the coil spring 147 is linked to the casing 8 or the like. The coil spring 147 will extend when the slide cam 144 moves forward. In other words, the coil spring 147 will urge the slide cam 144 in a direction that returns the slide cam 144 to its original position prior to movement.

The slide cam 144 has an inclined surface 135 that inclines upward from left to right, an upper flat portion 136 that extends rightward from the upper end of the inclined surface 135, and a lower flat portion 137 that extends leftward from the lower end of the inclined surface 135. The slide cam 144 is capable of sliding between a position in which the slide cam 144 supports the push rod 142 on the lower flat portion 137 and a position in which the slide cam 144 supports the push-rod 142 on the upper flat portion 136. As noted above, the push rod 142 is capable of sliding in the vertical direction. When the slide cam 144 moves leftward from the state shown in FIG. 17, the push rod 142 will rise along the inclined surface 135. In this way, the upper end of the push rod 142 will be in contact with the input portion 106, and an upward force will be applied to the input portion 106.

Next, the operation of the maintenance mechanism 140 will be described. FIG. 18 is a drawing which serves to describe the operation of the maintenance mechanism 140. Note that in FIG. 18, the pinion gear 145 is omitted. In the present embodiment, maintenance will be performed only when a sufficient quantity of ink to perform maintenance is remaining inside the sub tank 37. Thus, in the event that a maintenance command is input when there is little ink remaining inside the sub tank 37, maintenance will be performed after the ink supply operation noted above has been performed.

The controller will cause the carriage 34 to move to the maintenance position (the position shown in FIG. 4 and FIG. 6) when the controller determines that the quantity of ink remaining inside the sub tank 37 is at a predetermined value or greater based upon the output value of an optical sensor, the count value of a dot counter, or the like. In the event that the ink color on which maintenance is to be performed has been selected (e.g., a user can select the ink color; in another example, the controller can select the ink color in response to the previous print condition), the controller will cause the arm 100 and the push rod 142 corresponding to the requested ink color to move to a position that matches in plan view (see FIG. 18A). In this state, the nozzles 39 of the head 35 are directly above the ink tray 141.

Next, the controller will drive the drive mechanism 143, and will cause the slide cam 144 to move rearward (in the leftward direction of FIG. 18). In other words, the controller will cause the pinion gear 145 (see FIG. 17) and the rack gear 148 of the slide cam 144 to mesh. Then, the controller will apply the drive force of the LF motor 71 to the slide cam 144. The push rod 142 will be raised up by the inclined surface 135 of the slide cam 144. An upward force will be applied to the input portion 106 of the arm 100 corresponding to the selected ink color. The arm 100 will pivot in the counter clockwise direction due to this force. In this way, the pressing portion 105 of the rearward arm 103 will push the plate 55 of the sub tank 37 downward. The result is that, as shown in FIG. 18B, the sub tank 37 will be compressed, and the ink, air, etc. inside the sub tank 37 will be discharged from the through hole 57. Ink and air will be ejected from the nozzles 39 via the ink supply passage 51. In this way, sludge and air bubbles in the ink passages from the sub tanks 37 to the nozzles 39 will be eliminated. This elimination process will be hereinafter referred to as a positive pressure purge.

When the positive pressure purge is complete, the controller will cause the slide cam 144 to move forward (the rightward direction of FIG. 18). The controller will release the meshing between the pinion gear 145 and the rack gear 148. In this way, the spring force of the coil spring 147 will be applied to the slide cam 144. The push rod 142 will descend along the inclined surface 135 of the slide cam 144. In this way, the pressing force applied to the sub tank 37 will be released and the push rod 142 will move away from the input portion 106 of the forward arm 104. The sub tank 37 will expand, and will return to its original shape (see FIG. 18C). At this point, the pressure inside the sub tank 37 will be below the aforementioned predetermined negative pressure. The result is that the coil spring 152 of the female joint 63 will be compressed, and air will flow in from the hole 153. Note that because the nozzles 39 are microscopic holes, air will not flow from the nozzles 39 even if air flows in from the hole 153.

In addition, when the positive pressure purge is completed, the controller will drive the wiper 146. In this way, ink adhered to the nozzle surface due to ink injection will be wiped off (see FIG. 18D). This operation will be hereinafter referred to as wiping. When wiping is performed, different colors of ink on the nozzle surface can be prevented from mixing.

When wiping is performed, other colors of ink may enter into the nozzles 39. Because of this, a so-called flushing will be performed. In other words, the controller will control the piezoelectric elements (see FIG. 12), and will cause minute quantities of ink to be discharged from the nozzles (see FIG. 18E). When the aforementioned maintenance is performed, the effect of cleaning the ink passages from the sub tanks 37 to the nozzles 39 will be obtained. In addition, the effect of eliminating air bubbles and sludge inside the head 35 will be obtained. In addition, the effect of eliminating mixed ink colors, preventing the nozzle surface from drying, etc. will also be obtained. In addition, in the present embodiment, because a positive pressure purge is possible with respect to only the passages corresponding to selected ink colors, the quantity of ink consumed during maintenance can be reduced compared to when all colors are purged.

Figure 19:
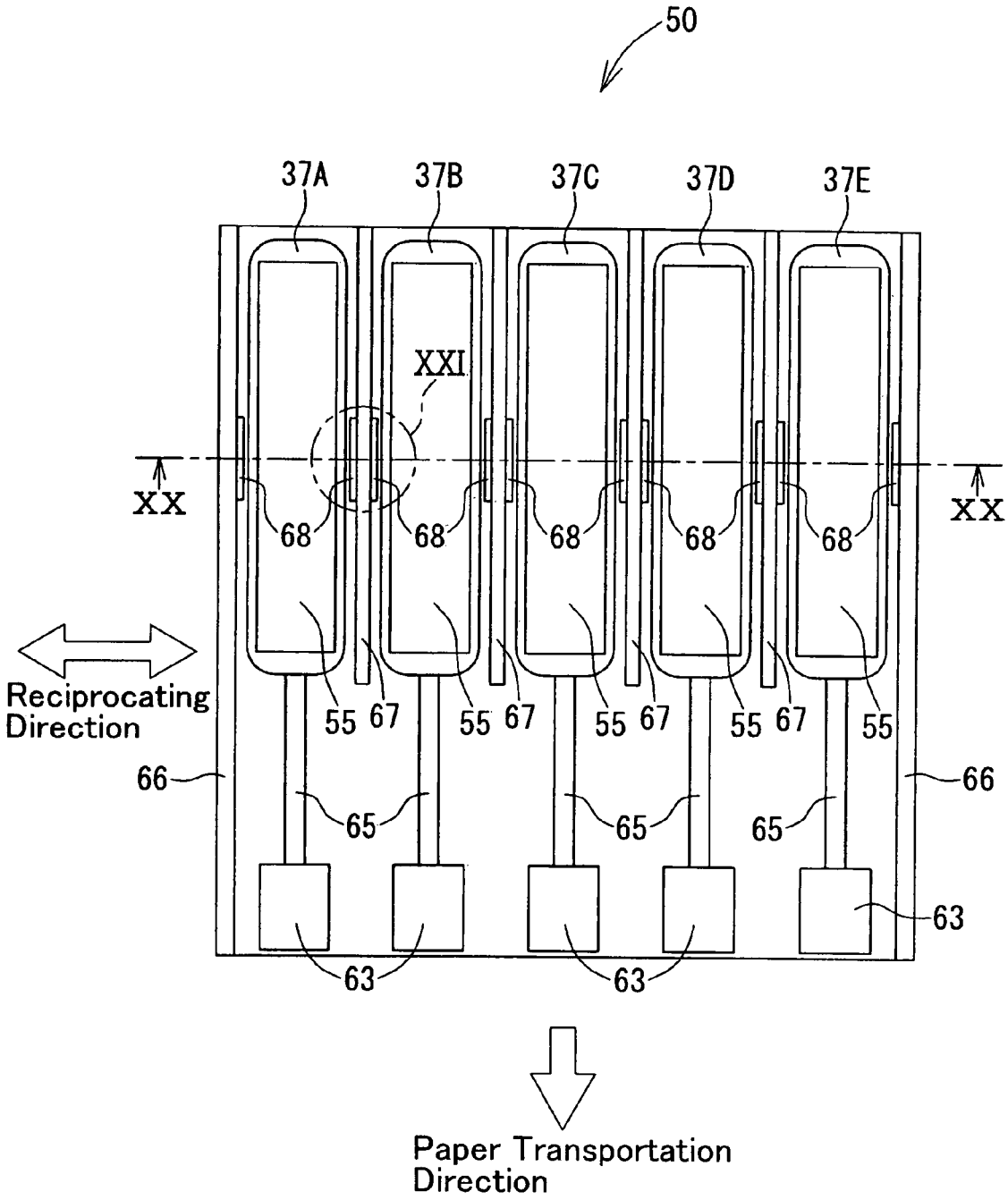
FIG. 19 shows a plan view of a tank storage chamber.
Figure 20:
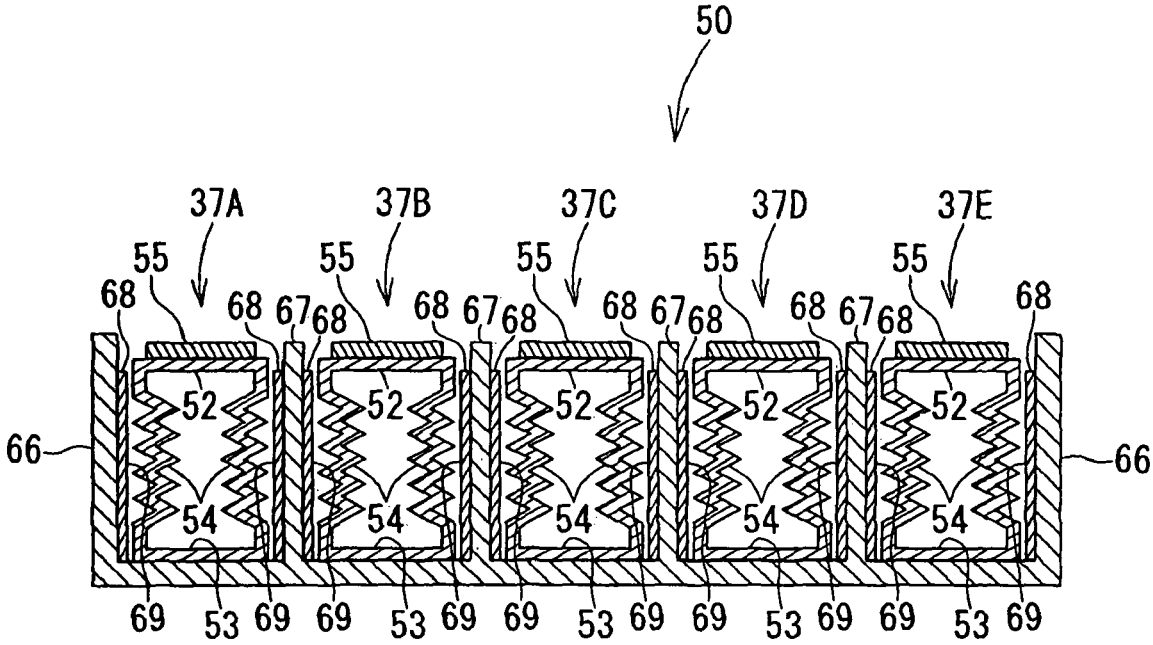
FIG. 20 shows the cross-sectional view of line XX-XX of FIG. 19.

FIG. 19 shows a plan view of the tank storage chamber 50. FIG. 20 shows the cross-sectional view of line XX-XX of FIG. 19. Note that FIG. 19 shows a state in which the arms 100 have been removed. Outer walls 66 (see FIG. 9, FIG. 19, and FIG. 20) that extend from the bottom surface of the tank storage chamber 50 upward (the height direction of the multi-function device 1) are provided on both sides of the tank storage chamber 50 (the horizontal direction of FIG. 19). Each outer wall 66 is long in the rearward direction of the tank storage chamber 50 (the vertical direction of FIG. 19). The height of each outer wall 66 is slightly higher than the positions (height) of the plates 55 in a state in which the sub tanks 37 are not contracted (see FIG. 20). In addition, inner walls 67 are provided between each two adjacent sub tanks 37. Because there are five sub tanks 37 (37A to- 37E) in the present embodiment, there are four inner walls 67. The four inner walls 67 are aligned in the reciprocating direction of the carriage 34 (the horizontal direction of FIG. 19). The length of each inner wall 67 in the width direction (the vertical direction of FIG. 19) is slightly longer than the length of the sub tanks 67 in the width direction (the vertical direction of FIG. 19). Each inner wall 67 has a flat shape. The height of each inner wall 67 is approximately the same height as the positions (height) of the plates 55 in a state in which the sub tanks 37 are not contracted. There is a predetermined gap between the outer walls 66 and the side surfaces 54 of the sub tanks 37 (e.g., 2 millimeters). There is a predetermined gap between the inner walls 67 and the side surfaces 54 of the sub tanks 37 (e.g., 2 millimeters). Because of this, the side surfaces 54 of each sub tank 37 will not come into contact with the outer walls 66 or the inner walls 67.

Because the outer walls 66 are provided, the sub tanks 37 (37A and 37E) can be prevented from falling over toward the sides. In addition, because the inner walls 67 are provided, two adjacent sub tanks 37 can be prevented from coming into contact during the reciprocal movement of the carriage 34. The result is that the head 35 can optimally discharge ink.

The sub tanks 37 each have a flat upper surface 52 and a flat bottom surface 53. Furthermore, the sub tanks 37 each have side surfaces 54 (body portions) formed into a bellows shape. When the sub tanks 37 receive a pressing force from the arms 100, it will be possible for the side surfaces 54 to deform so as to swell outward in the horizontal direction (this deformation will hereinafter be referred to as "expansive deformation"). As noted above, the sub tanks 37 are horizontally long when viewed from the sides. In other words, each sub tank 37 is long in the rearward direction of the multi-function device 1 (the vertical direction of FIG. 19). In addition, each sub tank 37 is short in the width direction (the horizontal direction of FIG. 19). Because of this, the approximate central portion in the rearward direction of each sub tank 37 (the horizontal direction of FIG. 10, the vertical direction of FIG. 19) will be the portion that most easily deforms. Regulators 68 are provided in the tank storage chamber 50 in order to control this deformation. Ten regulators 68 are present in the tank storage chamber 50. The construction of one regulator 68 will be first described below.

Figure 21:
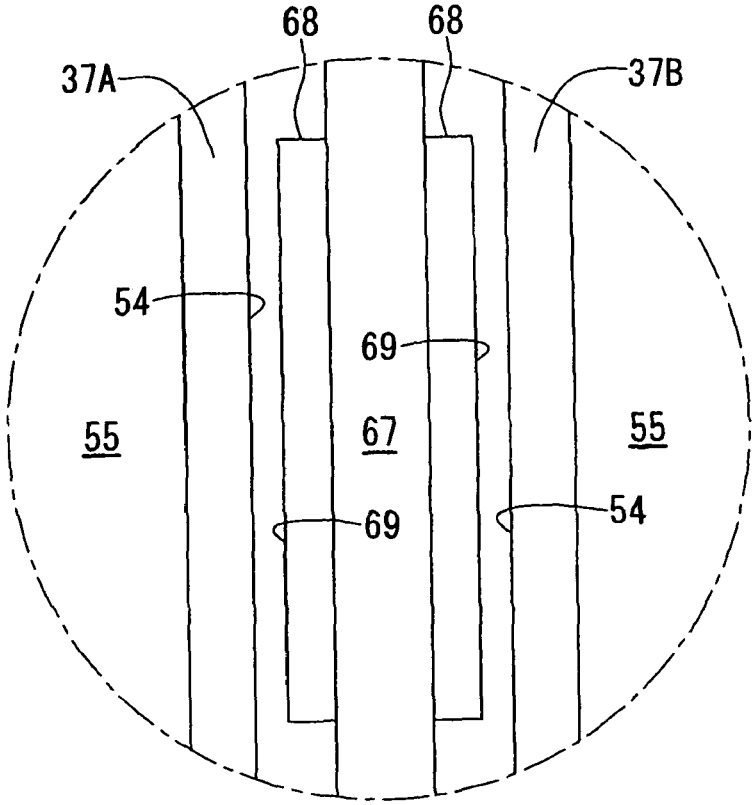
FIG. 21 shows an expanded view of region XXI of FIG. 19.

FIG. 21 shows an enlarged view of the area XXI of FIG. 19. The regulators 68 are arranged to be adjacent to the side surfaces 54 of the sub tanks 37. In other words, the regulators 68 are arranged to be adjacent to the side surfaces 54 that extend in the height direction of the sub tanks 37. The regulators 68 each have a long flat shape in the vertical direction of FIG. 20 (the direction in which the sub tanks 34 expand and contract). The regulators 68 face the approximate center of the side surfaces 54 in the width direction (the vertical direction of FIG. 19). The regulators 68 are fixed to the outer walls 66 (or the inner walls 67) (see FIG. 20). In other words, in the present embodiment, the regulators 68 are supported by the outer walls 66 (or the inner walls 67). Note that the regulators 68 need not be necessarily constructed separately from the outer walls 66 (or the inner walls 67). The regulators 68 may be constructed so as to be integral with the outer walls 66 (or the inner walls 67). In addition, the regulators 68 may be fixed to the bottom surface of the tank storage chamber 50.

Each regulator 68 has a first side surface facing an outer wall 66 (or inner wall 67) (the side surface that will come into contact with an outer wall 66 (or an inner wall 67)), and a second side surface 69 on the opposite side of the first side surface (see FIG. 20 and FIG. 21). The side surface 69 is flat. The side surface 69 is arranged near the approximate center of the side surface 54 in the width direction (the vertical direction of FIG. 19). The side surface 69 faces the approximate center of the side surface 54 in the width direction across a predetermined distance (e.g., about 0.5 mm to 1 mm). The aforementioned predetermined distance is set as follows. In other words, the side surfaces 69 will not come into contact with the side surfaces 54 when the sub tanks 37 are not elastically deformed, but there is a possibility that the side surfaces 69 will come into contact with the side surfaces 54 when the sub tanks 37 have been elastically deformed. In other words, it is possible for the side surfaces 69 to not come into contact with the side surfaces 54 when a pressing force is not applied to the subtanks 37, and the side surfaces 69 to come into contact with the side surfaces 54 when a pressing force has been applied to the subtanks 37. The degree (distance) that the side surfaces 54 will elastically deform depends upon the size of the sub tanks 37, the shape of the sub tanks 37 (particularly the length of the sub tanks 37 in the rearward direction), the type of material used to construct the side surfaces 54, and the like. Thus, the aforementioned predetermined distance can change in response to these conditions. The aforementioned predetermined distance can be changed by changing the distance between the outer walls 66 (or the inner walls 67) and the sub tanks 37. In addition, the aforementioned predetermined distance can be changed by changing the thickness of the regulators 68.

A pair of regulators 68 is provided for each sub tank 37. A pair of regulators 68 is aligned in the direction in which the carriage 34 reciprocally moves (the horizontal direction of FIG. 19). One sub tank 37 is arranged between each pair of regulators 68. Each regulator 68 is provided between an outer wall 66 and a side surface 54, and between an inner wall 67 and a side wall 54 (see FIG. 20). Note that the side surfaces 69 may be arranged in other positions as long as the regulators 68 are adjacent to the approximate center of the side surfaces 54 in the width direction (the vertical direction of FIG. 19). For example, in addition to the regulators 68 of FIG. 19, additional regulators may be provided on both sides of each regulator 68 (the upper side and lower side of FIG. 19). However, the slide load received from the side surfaces 69 when the sub tanks 37 expansively deform will increase as the number of regulators 68 arranged in the tank storage chamber 50. The number of regulators 68 is preferably set in consideration of this fact.

As shown in FIG. 19 and FIG. 20, the regulators 68 are approximately the same height as the positions (height) of the sub tanks 37 (without the plates 55) when in the uncontracted state. In other words, the side surfaces 69 are arranged on the sides of the side surfaces 54 of the sub tanks 37. In addition, the length of the regulators 68 in the width direction (the vertical direction of FIG. 19) is shorter than the height of the sub tanks 37. In other words, the side surfaces 69 of the regulators 68 are long in the vertical direction (the direction in which the sub tanks 37 expand and contract (the vertical direction of FIG. 20)).

The side surfaces 54 of the sub tanks 37 are capable of elastic deformation in the vertical direction. The sub tanks 37 will contract due to a pressing force being applied from above (the upper side of FIG. 20) by the arms 100, and will return due to the pressing force being released. The side surfaces 54 can be expansively deformed when the sub tanks 37 have received a pressing force from the arms 100 for the purpose of ink supply, positive pressure purge, flushing, or the like. More specifically, the side surfaces 54 are capable of not only contracting in the vertical direction, but also swelling outward. In particular, the side surfaces 54 will expansively deform easily when a pressing force is received in a state in which the holes 153 are closed (see FIG. 15). The noticeable point of expansive deformation is the approximate center of the side surfaces 54 in the width direction (the vertical direction of FIG. 19). The side surfaces 69 of the regulators 68 are arranged in positions adjacent to these approximate center portions (see FIG. 20). Because of this, the side surfaces 54 will come into contact with the side surfaces 69 of the regulators 68 when the side surfaces 54 expansively deform at the point the sub tanks 37 are contracted. In this way, the expansive deformation of the side surfaces 54 will be controlled by the side surfaces 69 of the regulators 68. The result is that the sub tanks 37 can be contracted in a stable position, and the amount of contraction of the sub tanks 37 can be fixed. A fixed amount of ink can be supplied from the ink cartridges 38 to the sub tanks 37. Cleaning of the head 35 (positive pressure purge) can be performed without wasting ink.

In addition, the side surfaces 69 of the regulators 68 are only arranged in positions adjacent to the approximate center of the side surfaces 54 in the width direction. The contact area between the side surfaces 54 and the side surfaces 69 is small compared to when the side surfaces 69 are also arranged in other positions. Because of this, the slide load between the sub tanks 37 and the side surfaces 69 can be reduced, and the sub tanks 37 can be smoothly expanded and contracted.

As shown in FIG. 19, the flat surfaces 69 of the regulators 68 are long in the vertical direction. Thus, the contact area between the side surfaces 54 and the regulators 68 when the sub tanks 37 are contracted will be smaller than regulators that are long in the horizontal direction. The result is that the slide load between the sub tanks 37 and the side surfaces 68 can be reduced, and the sub tanks 37 can be smoothly expanded and contracted. In addition, the sub tanks 37 can be prevented from falling over because the side surfaces 69 face the side surfaces 54.

As noted above, a pair of regulators 68 sandwich each sub tank 37. The pairs of regulators 68 are aligned in the direction in which the carriage 34 reciprocally moves. Because of this, the expansive deformation of the sub tanks 37 when the sub tanks 37 are contracted can be more effectively prevented, compared to when the pairs of regulators 68 are not provided. Furthermore, the horizontal wobble of the sub tanks 37 that occurs when the carriage 34 moves reciprocally can be controlled by the regulators 68.

Figure 22:
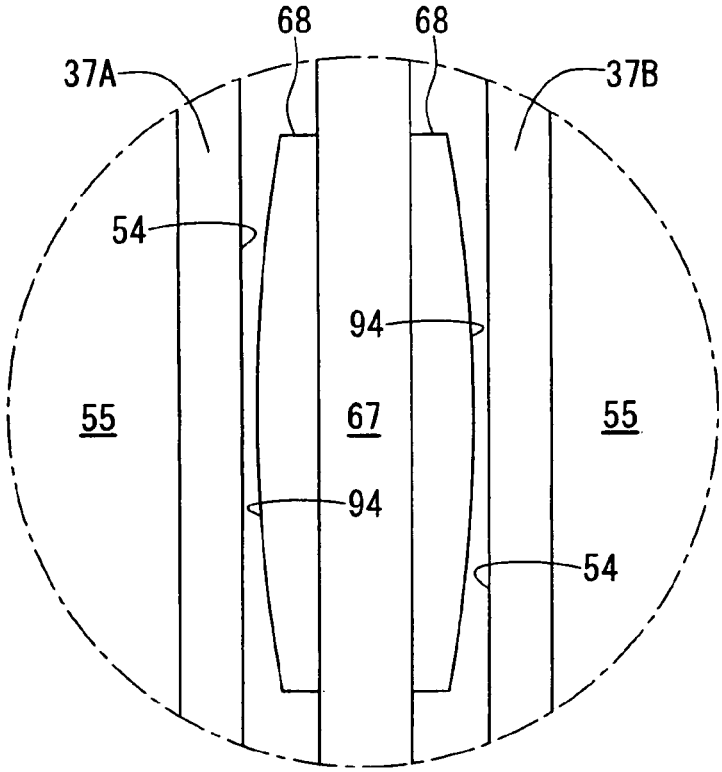
FIG. 22 shows a guide member having a guide surface curved in the horizontal direction.

FIG. 22 shows a plan view of a modified example of regulators 68. The guide surfaces 94 of the regulator 68 may be curved along the rearward direction of the multi-function device 1 (the vertical direction of FIG. 22). In other words, the guide surfaces 94 of the regulators 68 may be curved along a direction orthogonal to the direction in which the sub tanks 37 expand and contract. The point on the curved surfaces 94 facing the approximate center of the side surfaces 54 in the width direction (the vertical direction of FIG. 22) project outward the furthest toward the side surfaces 54. According to this construction, the curved surfaces 94 will come into contact with the side surfaces 54 only at the point where the expansive deformation is easiest. The slide load between the sub tanks 37 and the regulators 68 can be reduced, compared to when the guide surfaces are flat.

Figure 23:
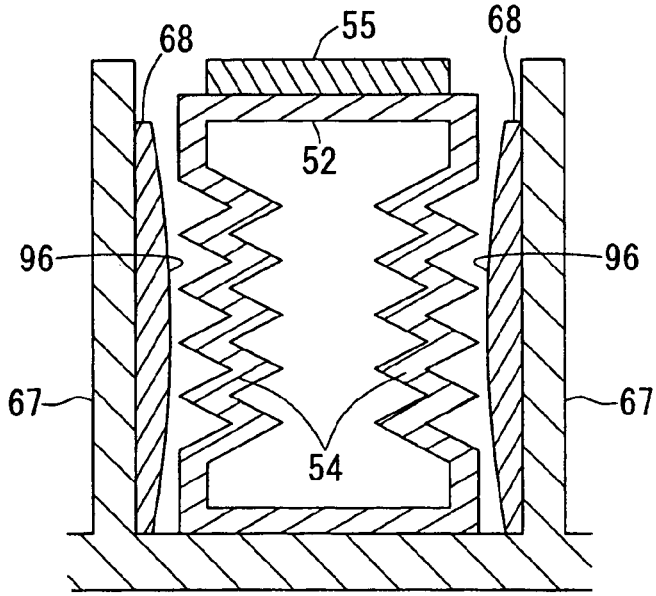
FIG. 23 shows a guide member having a guide surface curved in the vertical direction.

FIG. 23 shows a cross-sectional view of a modified example of the regulators 68. The guide surfaces 96 of the regulators 68 may be curved along the height direction of the multi-function device 1 (the vertical direction of FIG. 23). In other words, the guide surfaces 96 of the regulators 68 may be curved along the direction in which the sub tanks 37 expand and contract. The point on the curved surfaces 96 facing the approximate center of the side surfaces 54 in the vertical direction (the vertical direction of FIG. 20) project outward the furthest toward the side surfaces 54. According to this construction, the curved surfaces 96 will come into contact with the approximate center of the side surfaces 54 in the width direction only at the point where the expansive deformation is easiest. The slide load between the sub tanks 37 and the regulators 68 can be reduced.

Note that the regulators 68 shown in FIG. 22 or FIG. 23 are the same as the regulators 68 having flat surfaces 69, except that they have curved guide surfaces. In the present embodiment, curved guide surfaces were illustrated as a modified example of the flat side surfaces 69. However, the shape of the guide surfaces is not limited to flat surfaces and curved surfaces. The guide surfaces may have, for example, a spherical shape. However, in the event that the side surfaces 54 are bellows shaped, the shape of the side surfaces 69 preferably has no bumps facing the side surfaces 54.

In addition, the side surfaces 69 of the regulator 68 are long in the vertical direction, but other shapes may be adopted. For example, the side surfaces 69 of the regulator 68 may be long in the horizontal direction. However, in the event that the side surfaces 69 of the regulators 68 are long in the vertical direction, the sub tanks 37 can be prevented from falling sideways, and the slide load between the sub tanks 37 and the regulators 68 can be reduced. Because of this, the side surfaces of the regulators 68 are preferably long in the vertical direction.

In addition, in the aforementioned embodiment, a pair of regulators 68 sandwich each subtank 37, and each pair of regulators 68 is aligned in the direction in which the carriage 34 reciprocates. However, this construction need not be used. For example, each pair of regulators 68 may be aligned in the direction in which the print media is transported. The number of regulators 68 provided for each sub tank 37 need not be two, and may be one or three or more.

In addition, in the present embodiment, inner walls 67 and regulators 68 are provided in the tank storage chamber 50. However, the inner walls 67 do not necessarily need to be provided. Only the regulators 68 may be provided in the tank storage chamber 50.

In addition, in the present embodiment, the regulators 68 are mounted on the carriage 34 because the sub tanks 37 are mounted on the carriage 34. However, the sub tanks 37 and the regulators 68 do not necessarily need to be mounted on the carriage 34, and may be provided on the casing 8.

Second Embodiment

Figure 24:
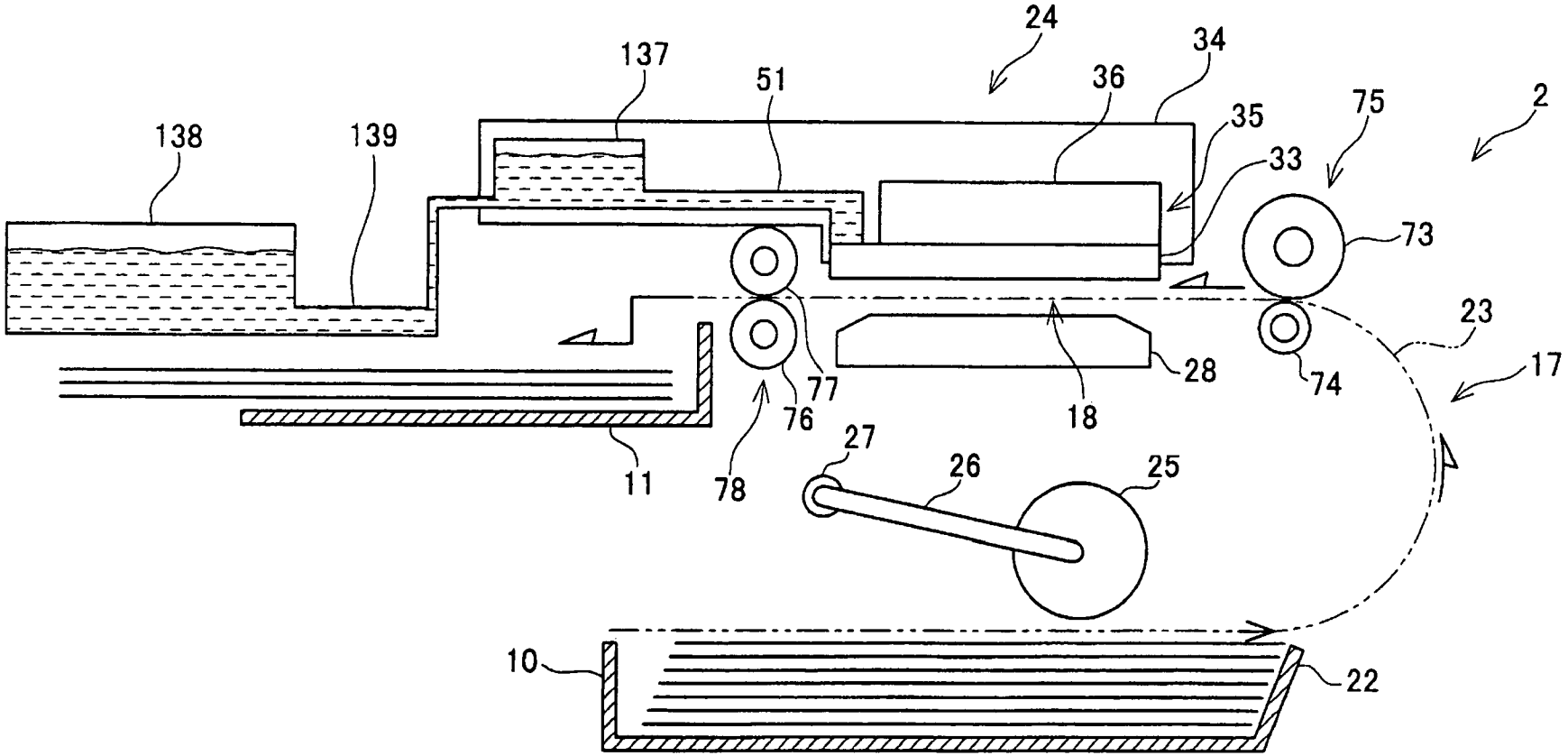
FIG. 24 shows a simple cross-sectional view of a print unit of a second embodiment.

FIG. 24 shows a simple cross-sectional view of a printer unit 2 of a third embodiment. In FIG. 24, the same reference numbers as the first embodiment will be used for the same elements as the first embodiment. In the present embodiment, the ink cartridges 138 and the sub tanks 137 are always connected when the ink cartridges 138 are mounted to the printer unit 2. The ink cartridges 138 and the sub tanks 137 are connected by tubes 139 having elasticity. The ink cartridges 138 and the sub tanks 137 are also connected when the head 35 is printing on printing sheets. Thus, ink can be supplied from the ink cartridges 38 to the sub tanks 137 even when the head 35 is printing on printing sheets. Note that the sub tanks 137 are elastically deformable (the fact that they are bellows shaped) as in the first embodiment. In other words, ink can be supplied from the ink cartridges 138 to the sub tanks 137 by pressing the sub tanks 137 just as in the first embodiment. In addition, like in the first embodiment, the aforementioned regulators 68 (not shown in FIG. 24) are provided in positions adjacent to the sub tanks 137.

Third Embodiment

Figure 25:
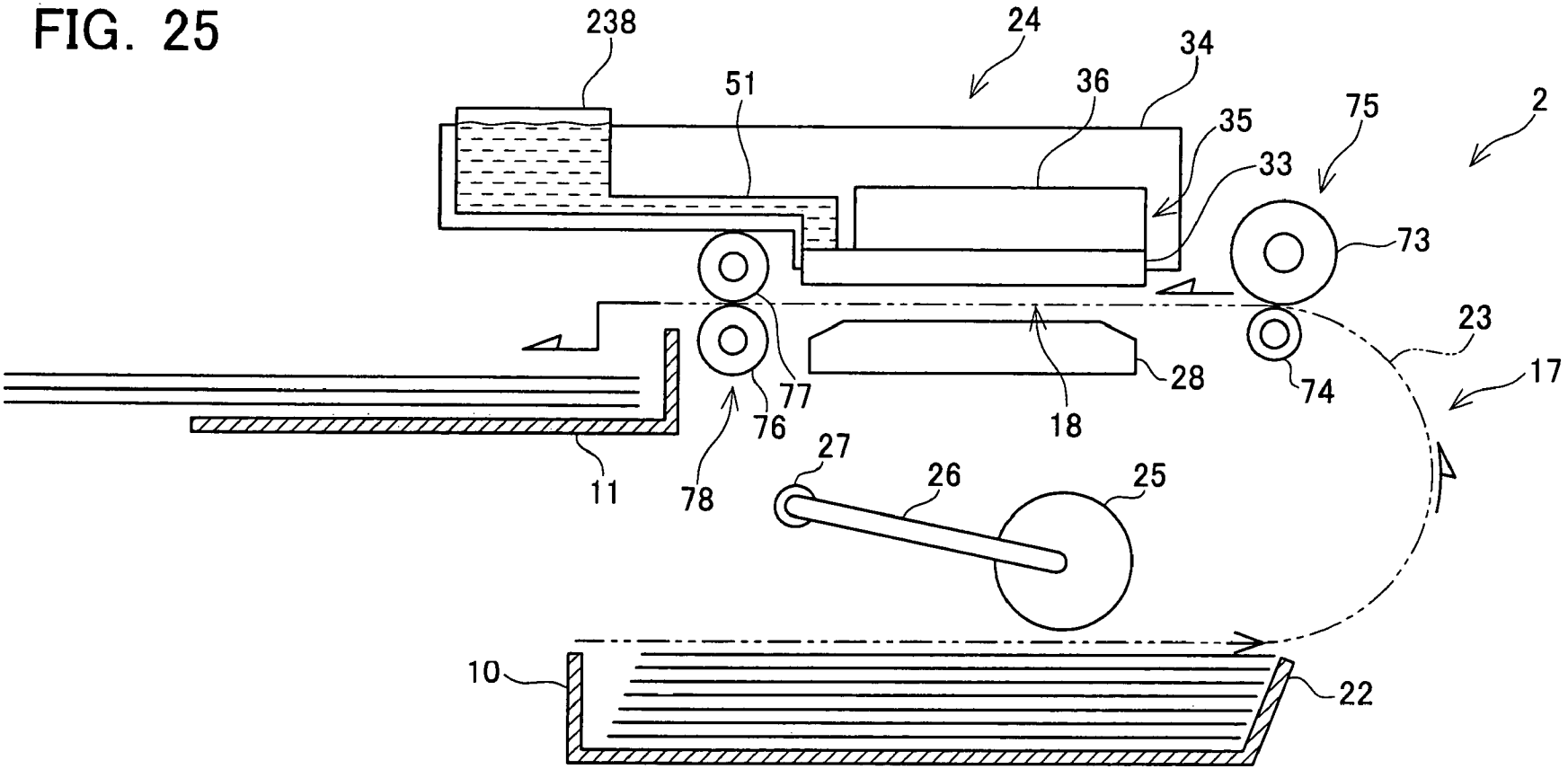
FIG. 25 shows a simple cross-sectional view of a print unit of a third embodiment.

FIG. 25 shows a simple cross-sectional view of a printer unit 2 of a third embodiment. In FIG. 25, the same reference numbers as the first embodiment will be used for the same elements as the first embodiment. In the present embodiment, the ink cartridges 238 are detachably mounted on the carriage 34. When the carriage 34 moves in a state in which the ink cartridges 238 are mounted on the carriage 34, the carriage 34 will move together with the ink cartridges 238. In the present embodiment, the ink cartridges 238 are constructed to be elastically deformable in the vertical direction. For example, the ink cartridges 238 have a bellows shape. The aforementioned regulators 68 (not shown in FIG. 25) are provided in positions adjacent to the ink cartridges 238.

What is claimed is:

1. An ink jet printer, comprising:

an ink jet head comprising an ink passage and a nozzle communicating with the ink passage;

an ink tank communicating with the ink passage of the ink jet head, where the ink tank is elastically deformable along a vertical direction, the ink tank comprising:

an upper surface;

a bottom surface; and a first side surface located between the upper surface and the bottom surface;

an actuator capable of applying a pushing force to the ink tank in the vertical direction; and a member located at a position which is adjacent to the first side surface of the ink tank, where the member does not move when the actuator applies the pushing force to the ink tank;

wherein the first side surface makes contact with the member in a case where the ink tank expands in a horizontal direction when the actuator applies the pushing force to the ink tank.

2. The ink jet printer as in claim 1;

wherein the member is located at a position which is adjacent to a central portion of the first side surface along the horizontal direction.

3. The ink jet printer as in claim 1;

wherein the first side surface does not make contact with the member in a state where the actuator does not apply the pushing force to the ink tank.

4. The ink jet printer as in claim 1;

wherein the member is long along the vertical direction.

5. The ink jet printer as in claim 1;

wherein in a front view of the predetermined side surface, the predetermined side surface is long along the horizontal direction.

6. The ink jet printer as in claim 1, further comprising:

a pair of the members;

wherein the ink tank further comprises a second side surface located between the upper surface and the bottom surface;

wherein the second side surface is located at an opposite side of the first side surface;

wherein one of the members is located at the position which is adjacent to the first side surface;

wherein the other of the members is located at a position which is adjacent to the second side surface; and wherein the second side surface makes contact with the member in the case where the ink tank expands in the horizontal direction when the actuator applies the pushing force to the ink tank.

7. The ink jet printer as in claim 6, further comprising:

a carriage on which the ink jet head, the ink tank, and the members are mounted;

wherein the carriage is capable of moving; and wherein a direction along which the members are aligned is identical to a direction along which the carriage moves.

8. The ink jet printer as in claim 1;

wherein the ink tank is long along the horizontal direction.

9. The ink jet printer as in claim 1, further comprising:

a plurality of the ink tanks; and a wall member located between adjacent two ink tanks.

10. The ink jet printer as in claim 9;

wherein the member is fixed to the wall member.

11. The ink jet printer as in claim 1, further comprising:

a main body comprising a space for housing an ink cartridge which is to be communicated with the ink tank; and a carriage on which the ink jet head, the ink tank, and the member are mounted;

wherein the carriage is capable of moving.

12. The ink jet printer as in claim 11;

wherein the actuator pressurizes ink within the ink cartridge to the ink tank by applying the pushing force to the ink tank and releasing the pushing force after applying the pushing force in a state where the ink cartridge is communicated with the ink tank.

13. The ink jet printer as in claim 1;

wherein the actuator applies the pushing force to the ink tank in order to discharge ink from the nozzle of the ink jet head.

14. The ink jet printer as in claim 13, further comprising:

an ink receiving tray that receives the ink discharged from the nozzle of the ink jet head when the actuator applies the pushing force to the ink tank.

15. The ink jet printer as in claim 1, further comprising:

a carriage on which the ink jet head, the ink tank, and the member are mounted;

wherein the carriage is capable of moving.

16. The ink jet printer as in claim 15;

wherein the ink tank is an ink cartridge which is detachably mounted on the carriage.

17. The ink jet printer as in claim 15, further comprising:

a main body comprising a space for housing an ink cartridge; and a tube located between the space and the ink tank;

wherein, in a state where the ink cartridge is housed in the space, the ink cartridge is communicated with the ink tank via the tube.

18. The ink jet printer as in claim 1;

wherein, in a state where the actuator does not apply the pushing force to the ink tank and the ink tank does not contract in the vertical direction, the member has an approximately same height as a height of the first side surface of the ink tank; and wherein the member is located at a position facing the first side surface of the ink tank.

* * * * *